US006942610B2

(12) United States Patent
St. Germain et al.

(10) Patent No.: US 6,942,610 B2
(45) Date of Patent: Sep. 13, 2005

(54) WEB FOLDING MACHINE

(75) Inventors: Patrick C. St. Germain, Iron River, WI (US); Vernon C. Wickman, Port Wing, WI (US)

(73) Assignee: Specialty Systems Advanced Machinery, Inc., Iron River, WI (US)

( * ) Notice: Subject to any disclaimer, the term of this patent is extended or adjusted under 35 U.S.C. 154(b) by 0 days.

(21) Appl. No.: 10/447,022

(22) Filed: May 28, 2003

(65) Prior Publication Data

US 2004/0242394 A1 Dec. 2, 2004

(51) Int. Cl.[7] ..... B31F 1/08
(52) U.S. Cl. ..... 493/424; 493/434
(58) Field of Search ..... 493/424, 434, 493/442, 432, 476, 405

(56) References Cited

U.S. PATENT DOCUMENTS 4,624,654 A * 11/1986 Boyd et al. ..... 493/194
5,015,317 A * 5/1991 Corey et al. ..... 156/197
5,492,588 A * 2/1996 Weder et al. ..... 156/251
5,842,964 A * 12/1998 Huber et al. ..... 493/434
6,024,682 A * 2/2000 Mandel et al. ..... 493/23
6,422,552 B1 * 7/2002 Chesno et al. ..... 270/32
6,440,053 B1 * 8/2002 Niedermeyer ..... 493/416
6,656,102 B1 * 12/2003 Nagano ..... 493/423

* cited by examiner

*Primary Examiner*—Eugene Kim
(74) *Attorney, Agent, or Firm*—Olson & Hierl, Ltd.

(57) ABSTRACT

A web folding machine for folding a continuously fed web into folded segments is disclosed. The machine includes a frame upon which the other components of the machine are mounted. A web supply provides continuous web material to these other components of the machine, with multiple feeds of the web material being processed in parallel relationship to one another. In one embodiment of the invention, web is pulled from a web supply by a pull roll station, which engages the web material to feed it at an approximately constant feed rate to a metering roll station. After proceeding through the metering roll station, the web reaches the folding station, where the web it is folded into a folded segment. In yet another embodiment of the invention, the web is first fed to a folding board that folds the web longitudinally. After the web is folded longitudinally by the folding board, it is fed to a pivoting marker web guide station that periodically pivots to vertically displace the web to create a marker. In a different embodiment of the invention, the folded segments are moved from the folding station to a packing station, which segregates the folded segments into accumulations and conveys the accumulations of folded segments away from the folding station.

13 Claims, 22 Drawing Sheets

WEB FOLDING MACHINE

FIELD OF THE INVENTION

The present invention relates to a web folding machine having a variable fold feature.

BACKGROUND OF THE INVENTION

Web folding and cutting machines have long been known in the material handling art. Generally, such machines have the capability of performing multiple operations on either a continuous web of material or on multiple separate pieces of web fed into such machines. For example, a typical web folding machine may comprise a rotary cutting and folding device having multiple drums or rolls for performing specific functions, the rolls including feed rolls, folding rolls, knife rolls, ironing rolls and packer rolls.

With such machines, a continuous web is stored on a web supply, such as a feed stock roll, located at a first end of the device. The continuous sheet of web is either pulled or fed through a preliminary forming step which may include folding the sheet lengthwise with a folding board. The folded web can then be fed through successive rolls within the machine that perform various sequential operations on the material, to include pulling the continuous web off of the feed stock roll, cutting the continuous web into segments having a predetermined length, folding the segments a predetermined number of times into folded articles having a predetermined folded length, and packing the folded articles in preparation for later packaging operations.

With regard to web folding operations, these rotary folding devices may utilize a set of cylindrical pull rolls, located downstream from the web supply, that use frictional forces existing between the web and roll outer surfaces to pull the web from the feed stock roll and feed it to a pair of folding cylinders. The folding cylinders co-act with one another to tuck and grip the web to create one or more folds in the web received from the pull rolls. With the tuck and grip method, as the web is deposited between a pair of folding cylinders, a pointed tucker blade located on the surface of one of the cylinders pushes or tucks the material into a space existing between the jaws of an open gripper located on the surface of the opposite cylinder, thus creating folded web segments having a predetermined length. This predetermined length is a function of the circumference of the outer surface of the folding cylinders existing between the tuck and grip mechanism located thereon.

As the shortest folded segment that a given folding machine is capable of producing is a function of the circumference of the folding cylinder's outer surface existing between the tuck and grip mechanisms located thereon, operators of present machines wishing to create a folded segment having a length shorter than the cylinder's circumference must replace the folding cylinders themselves with cylinders having a smaller diameter. Such cylinder replacement requires disassembly of the machine, resulting in costly production down-time. Thus, present cutting devices suffer the disadvantage of requiring a disassembly of the machine to decrease the length of folded web segment shorter than that which is possible of folding cylinders of a given diameter.

Rotary folding machines also suffer disadvantages resulting from the inherent complexity of the devices themselves, with problems such as material tearing or jamming occurring in the feeding, cutting, folding and packing operations performed on the web. For example, many prior art folding machines have rolls located upstream from the folding cylinders such that the upstream rolls and folding cylinders are displaced from one another by a given distance, thus creating an open space or gap between one or more of the upstream rolls and one or more of the folding cylinders. In transferring the web from the upstream rolls to the folding cylinders, it must traverse the open space or gap located there-between, thus increasing a likelihood of a jamming of the web material during a transfer of the web to the folding cylinders. Thus present web folding machines suffer the disadvantage of web jamming during a transfer of the web to the folding cylinders from upstream cylinders.

Present machines also suffer from disadvantages present during the folding operations themselves. In utilizing the tuck and grip method to create folds in the web, from the time the web is released from a given gripper until the time that it is gripped again on the opposite folding cylinder, the length of web is held in place on the surface of the cylinder only by the friction existing between the respective cylinder's surface and the web material. However, this friction may be insufficient to effectively hold the web, thus allowing slippage to occur between the web and folding cylinder outer surface. Thus, present machines suffer the disadvantage of slip occurring between the web and cylinder, causing the web to be gripped in the wrong location or resulting in a jamming of the machine due to an improper positioning of the web on the cylinder.

Also, present folding devices utilizing the tuck and grip method commonly use a tucker blade that is mounted to the cylinder via a pivoting bearing. The pivoting bearing enables the tucker blade to rotate slightly as it retracts from the space between the gripper jaws during the grip cycle, with the blade later returning to its original, un-rotated position via the force of a return spring. However, as is common in web processing operations, a build-up of dust or other debris may occur within the working parts of the rotating tucker blade that prevents the tucker blade from returning to its original, un-rotated position. If the tucker blade cannot return to its original, un-rotated position, it will cause damaging interference between the gripper jaws and tucker blade during the next revolution of the folding cylinders. Thus, because present folding devices have a tucker blade that is prone to interference from dust and debris, they suffer the disadvantage of jamming and causing damage to the folding cylinders themselves.

Furthermore, mechanical folding cylinders using the tuck and grip method presently place the gripper face on the radius defined by the outside diameter of the folding cylinder. The tucker blade thus protrudes from the opposing folding cylinder outside diameter by the distance required to sufficiently push the material into the gripper jaws. However, this configuration results in a tucker blade that protrudes significantly from the surface of the cylinder, thus resulting in both the web following a non-symmetrical path as it wraps around the folding cylinder and an increased likelihood of tearing. Because many folding cylinders have this protruding tucker blade configuration, they suffer the disadvantage of being prone to tearing the web material as it wraps around the folding cylinder and tucker blade.

The gripper jaws of present folding cylinders are cam-driven to an opened position and spring-biased or cam driven to a closed position. A cam follower attached to the moving gripper jaw follows a fixed cam typically mounted to a frame of the device. During a timing adjustment of the gripper jaws (an adjustment of the time period during which the jaw remains open or closed), the cams mounted to the frame must be moved to accommodate a desired change of time. However, because the cams of many present machines are bolted to the frame, the operation of the machine must stop to allow the operator to manually adjust the cam position through a loosening and tightening of the bolts that hold the cams to the machine frame. Because present machines require that its operation be stopped to make a cam (timing) adjustment of the gripper jaws, they suffer the disadvantage of inefficiency due to the costly "down time" required of the adjustment during article production.

During the production of folded articles, it may be useful during production to periodically elevate the web fed into the folding machine to produce a folded product having a location vertically displaced from surrounding folded articles. Such a displaced article may serve as a visual numerical marker for indication of the number of folded articles produced during production. Present folding machines periodically adjust the angle of the folding board to raise the elevation of the web fed into the machine. However, such an adjustment may result in a tearing of the web itself flowing over the folding board. Thus, present machines suffer the disadvantage of tearing the continuous web by periodically adjusting the angle of the folding board to create a displaced marker within the folded product.

Many present folding devices utilize a packing system that moves the folded articles from the surface of the folding cylinder to a conveying system that both segregates predetermined quantities of folded articles and moves the quantities away from the folding cylinders towards a packaging operation (not discussed). These packing systems often utilize packing fingers that pivot away from the cylinder to lift and move the folded article from the surface of the folding cylinder to a screw conveyor. The screw conveyor, which comprises one or more helical screws positioned generally perpendicular to the folding cylinders, accepts a predetermined quantity of folded articles from the packing fingers to between the flights of the screw to establish the segregated quantities of folded articles.

After a pre-determined quantity of folded articles is moved to between the screw flights, the screws rotate to move the quantity laterally away from the folding cylinders and towards the packaging operation. However, the quantity of folded articles placed between the flights of a given screw is limited by the pitch of the screws themselves and the thickness of the folded articles packed therein. Thus the quantity of the folded articles placed therein cannot have a combined width that exceeds the flight-to-flight distance. To accommodate such a quantity, an operator has to change the helical screws of the machine to have a pitch wide enough to accept a given quantity of fold articles made from a web material of given thickness, again resulting in costly production down time. Present machines using such screw packing systems thus suffer the disadvantage of requiring the operator to change helical screws to accommodate a variety of web material thicknesses and folded articles quantities.

Thus, there is a need for an apparatus and method that overcomes the disadvantages of: requiring a disassembly of the machine to vary the folded length of the finished product; web jamming during web transfer to the folding cylinders; creating improperly folded articles or incurring machine malfunction due to web slippage against the folding cylinders; incurring machine malfunction due to the tucker blades not returning to a non-rotated position; tearing the web material due to the substantial protrusion of the tucker blade in relation to the cylinder surface; incurring machine downtime due to manual timing adjustments of the gripper jaw cams; tearing the continuous web by periodically raising the folding board to create a visual marker; and inefficiency of operation due to a changing the conveying screws to accommodate a variety of product quantities and thicknesses.

SUMMARY OF THE INVENTION

The present invention provides a novel and improved adjustable web folding machine that minimizes the disadvantages associated with the prior art machines and provides advantages in construction, mode of operation and use. One embodiment of the machine comprises a longitudinal frame having a pull roll station, metering roll station and folding station, all located respectively downstream from a web supply located proximal to a leading end of the frame. Other embodiments of the machine may further comprise various modifications to the folding mechanisms of the folding cylinders, at least one folding board and marker roll station upstream from the pull roll station, and a packing station downstream from the folding station.

The pull roll station comprises a pair of pull rolls rotatably mounted to the frame and driven to pull the web from the web supply. Preferably, each set of pull rolls is provided with a separate drive motor so that individual speed adjustments can be made for each set of pull rolls. The web material drawn from the web supply by the pull rolls is then fed at a constant rate to at least one metering roll station located downstream from the pull roll station. The metering roll station comprises a pair of driven metering rolls rotatably mounted to the frame and a rotatable take-up roll located between the metering rolls and the pull rolls. The metering rolls can adjust the rate of feed of the web to at least one folding cylinder of the folding station located downstream from the metering station. At the folding station, the web can be made to slip relative to the folding cylinder, thus allowing the folding cylinders to make a folded web segment having a length less than one half of the circumference of the cylinders themselves, if desired.

Any portions of slack or festoon in the web material created between the pull roll station and the metering rolls by variations in the rotational speed of the metering rolls is held against the slack take-up roll, preferably a fenestrated or perforated roll which is driven to rotate substantially in synchronism with the metering rolls. In one embodiment of the invention, at least one metering roll is contiguous with at least one folding cylinder for direct transfer of the web from the metering station to the folding station. The metering rolls and/or folding cylinders may optionally include at least one perforator unit for creating a line of perforation of predetermined intervals in the web to facilitated a separation of the web along the perforated lines into articles.

The folding station or assembly located downstream from the metering station comprises a pair of driven, co-acting folding cylinders rotatably mounted to the frame. Each folding cylinder is provided with a folding mechanism for creating a fold in the web when the cylinders co-act with one another. Preferably, the folding cylinders are equipped with vacuum ports for releasably retaining the web material on the folding cylinder during the mechanical folding of the web. As the web is deposited between the pair of folding cylinders, a pointed tucker blade located on the surface of one of the cylinders pushes or tucks the material into a space existing between the open jaws of an open gripper located on the surface of the opposite cylinder, thus creating a crease for the folded web segments.

In another embodiment of the machine, the tucker blade located on outer surface of each folding cylinder is of a reduced-radius for co-action with the corresponding gripper located on the respective other cylinder of the pair. With this configuration, both the tucker blade and gripper protrude from the surface of their respective cylinders by only half the distance normally required of a tucker blade that interacts with a gripper mounted flush with a cylinder's surface. This reduction in "protrusion distance" of a tucker blade reduces the occurrence of an unwanted tearing of a web overlying the blade itself. The angle of the leading edge of the tucker blade is configured to enable a proper "wiping" of the web from the gripper jaw surface to occur. Also, the location of the tucker blade is fixed in relation to the surface of the cylinder instead of being mounted on a pivoting bearing so that the dust and debris associated with web folding procedures have no detrimental effect on folding cylinder operation.

The grippers of the folding cylinders of a different embodiment of the machine are cam actuated and operationally adjustable during their rotation. The rotational location of the cams in relation to a given cylinder dictates the timing of the opening and closing operation of a given gripper, which is attached to a cam follower. The cams are secured to the frame of the machine with spring-biased, locking bolts that are inserted through radial slots in each respective cam plate. These bolts are hydraulically locked and unlocked to facilitate quick adjustment of the cams in relation to the frame while not requiring disassembly of the machine or production down-time.

In yet another embodiment, the outer surface of each folding cylinder also has a plurality of vacuum ports located therein for releasably holding the web material to the cylinder's outer surface for a predetermined time duration. The vacuum ports, located proximal to the tucker blade of each respective cylinder, maintain tension on the web when the gripper releases the web segment. The vacuum ports may be used with or without a knurled, web contacting cylinder surface to allow products of different material thickness to be fed into the folding cylinders without changing the spatial relationship (gap) existing between the cylinders themselves. The vacuum ports can be provided about the entire peripheral surface of the folding cylinder, if desired.

A different embodiment of the machine may feed the web to a pivoting marker roll station prior to the web reaching the pull roll station. The marker station is comprised of a pair of rotatable marker rolls pivotably attached to the frame and moveable at a predetermined time from a first, un-pivoted position to a second, pivoted position to vertically displace the feed of web through the rolls by a predetermined distance. The periodic pivoting of the marker rolls thus provides a vertically displaced marker after a predetermined quantity of folded web segments has been created by the machine. The marker rolls also serve as web guides during machine operation.

In yet a different embodiment of the invention, the folded segments are moved to a packing station. The packing station comprises one or more packing fingers working in conjunction with one or more screw separators. The station may optionally comprise packing assist fingers in addition to the packing fingers and screw separators. The packing fingers of the packing station move into and out of grooves located on each respective folding cylinder's surface to move folded segments from the surface of the cylinder to the screw separators.

The packing assist finger may be used within the packing station in conjunction with the packing fingers to subsequently hold within the screw separators the web segments unloaded by the packing finger. The screw separators separate the folded segments into variable-count groups or accumulations by accepting a predetermined quantity of folded segments between adjacent flights of the screw. After accepting the accumulation of folded segments between adjacent flights of the screw, the screw separator is rotated to convey the accumulation away from the cutting and folding station and to position subsequent empty flights proximal to the station to accept additional accumulations of folded segments therefrom.

The screw separators each comprise a shaft rotatably mounted to the frame, proximal to the folding cylinders of the folding station. Each shaft has a flexible thread attached thereto with flights having an adjustable pitch. The leading end of the flexible thread is rigidly mounted to one end of a rotating shaft while the terminal end of the screw is allowed to "float" on the shaft. Because the thread is flexible, it can stretch lengthwise along the shaft to increase the pitch of the screw. An increased pitch of the screw can thus accommodate an increased accumulation of folded web segments therein. Likewise, the thread, in a compressed or un-stretched state, can accept a reduced accumulation of folded segments between each flight, to include single folded web segments.

During constant speed machine operation the surface speed of pull rolls, slack take-up roll, metering rolls and folding cylinders is the same. A tucker on one folding cylinder inserts the web into an open gripper on the opposing folding cylinder. As the folding cylinders rotate the gripper closes, holding the web material tight on the circumference of the folding cylinder. As the folding cylinders rotate and pull the web material to a drop-off point, which is about one half of the product width from the machine center line. At that point, the grippers open to release the material.

Vacuum ports and(or) friction between the folding cylinders continues to pull material through the folding cylinders, forming a small accordion-shaped loop until the next tucker-gripper interaction. The gripper then pulls the web material, which straightens out the loop, to the opposite side release point. The distance between both release points (the product width) is equal to one half of the folding cylinder circumference. As the folding cylinders continue to rotate, another accordion-shaped loop is formed, which is then pulled back to the other release point by the next tucker-gripper interaction. Repeated folding cylinder rotations provide a continuous stream of zig-zag folded web material.

The present machine is also capable of variable speed operation. In such a case, the pull rolls operate at a surface speed relatively slower than the folding cylinders by a factor of variable width web divided by the normal or machine design width of web. When the gripper closes on the web during the variable speed operation, speed of the web feed must match the surface speed of the folding cylinders, and the surface speed of the metering rolls must, of course, match the surface speed of the folding cylinders and the speed web.

During the time period that the gripper pulls the web material around to a predetermined variable drop off point, more material is pulled than is provided by the relatively slower constant velocity pull rolls. The extra required material is obtained from a previously generated loop or festoon that is controlled by the slack take-up roll. The length of web from the grip point to the drop-off point is substantially equal to the amount of web supplied by the slower pull rolls plus the amount of web stored in the loop. Just after the gripper releases the material, the metering rolls slow down to a surface speed slower than both the folding cylinders and the pull rolls. The slower surface speed causes the material to slip across the vacuum ports and between the surfaces of the folding cylinders, i.e. between the nip, to form a new loop or festoon.

During the slip period, the amount of web allowed to pass through the folding cylinders is equal to the amount of web needed to produce the variable width product. Just prior to the tucker-gripper interaction, the metering rolls accelerate to match the surface speed of the folding cylinders. This allows the gripped web again to travel at the same speed as the gripper.

The gripper on the opposite folding cylinder then pulls the web around to the variable drop-off point, the amount of web again being substantially equal to the amount of web provided by the relatively slower, constant velocity pull rolls plus the material stored in the loop. The metering rolls have one deceleration and one acceleration phase for each tucker gripper interaction. These processing steps are repeated for each tucker-gripper interaction, causing the material to be folded into a zig-zag folded product with a length less than the normal machine design width.

DESCRIPTION OF THE PREFERRED EMBODIMENTS

Figure 1:
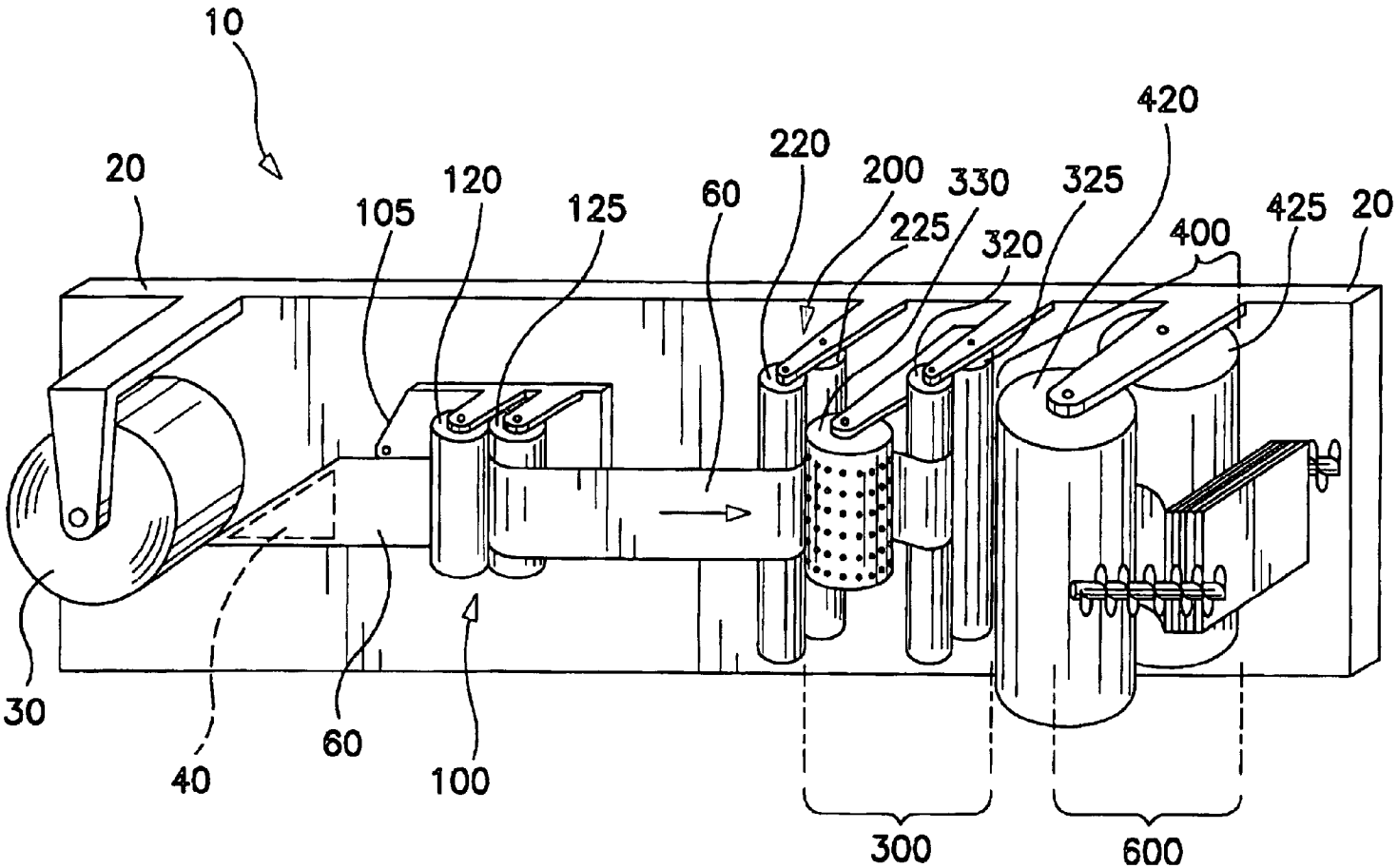
FIG. 1 is a schematic side perspective view of a web folding machine and a continuous web at various stages of the folding process.

The invention disclosed herein is, of course, susceptible of embodiment in many different forms. Shown in the drawings and described herein below in detail are preferred embodiments of the invention. It is understood, however, that the present disclosure is an exemplification of the principles of the invention and does not limit the invention to the illustrated embodiments. For ease of description, a web folding machine embodying the present invention is described herein below in its usual assembled position as shown in the accompanying drawings, and terms such as upper, lower, horizontal, longitudinal, etc., may be used herein with reference to this usual position. However, the web folding machine may be manufactured, transported, sold, or used in orientations other than that described and shown herein.

Referring to FIG. 1, the apparatus embodying the present invention provides a web folding machine 10 for receiving a web from one or more web supplies, i.e. one or more continuously wound rolls of web material, and processing that material by folding it into zig-zag shaped segments, which may be continuous, perforated into separable articles before folding, or cut into individual articles after folding. One embodiment of the machine 10 comprises a longitudinal frame 20 having a pull roll station 200, metering roll station 300 and folding station 400 attached thereto, all located respectively downstream from a web supply 30 located proximal to a leading end of the frame 20. Other embodiments of the machine may further comprise, alone or in combination, various modifications to the folding mechanisms of the folding station 400, a folding board 40 and marker station 100 attached to the frame 20 upstream from the pull roll station 200, or a packing station 600 attached to the frame downstream from the folding station 400.

Although machine 10 can process multiple webs simultaneously, for ease of understanding and clarity of illustration, it is shown in FIG. 1 as processing a single web 60 from a single web supply or feed stock roll 30. Thus, where additional web supplies are utilized to provide additional webs to the machine 10 for simultaneous processing operations, it is understood that additional folding boards, marker stations, pull roll stations and metering stations would be utilized in substantial parallel relation to one another to process and feed the additional webs to the common respective folding and packing stations 400 and 600.

Referring again to FIG. 1, a continuous web 60 is drawn from the web supply 30 by the pull roll station 200, located downstream therefrom. The pull roll station 200 comprises a pair of driven pull rolls 220 and 225 that utilize frictional forces existing between the rolls' respective outer surfaces and the web 60 to pull it from the web supply 30. The pull rolls 220 and 225 are rotatably mounted to the frame 20 preferably "side-by-side" of one another and substantially axially parallel to the cylinders of the folding station 400. In maximizing the rolls' surface area to pull the web from the supply, opposite surfaces of the pull rolls contact the web 60, with the path of the web approximating an "S" shape as it passes through the pull rolls.

The pull rolls 220 and 225 are driven to rotate at a substantially constant rate by a power source to pull the web 60 from the web supply 30 and feed it to the metering station 300. Pull rolls 220 and 225 can be driven by electric, hydraulic or pneumatic motors, or any other mechanism that can impart a rotational motion to the rolls. The rate of rotation of the pull rolls 220 and 225 is determined by the operator or by any automated control system understood in the art. The selection of the rate of rotation is dependant upon various factors, to include production goals, the type of web material processed and the number and type of folding operations performed on the web.

Prior art machines that provide multiple lanes or webs to be processed by the folders use a common drive motor to provide rotation to the pull rolls 220 and 225. This does not allow for small variable speed adjustments for each lane to compensate for material differences in each lane. The present design provides for an optional separate drive motor for each set of pull rolls for each lane, thus allowing for individual speed corrections for each lane. This also permits the running of a different type of web material on each lane.

Figure 2:
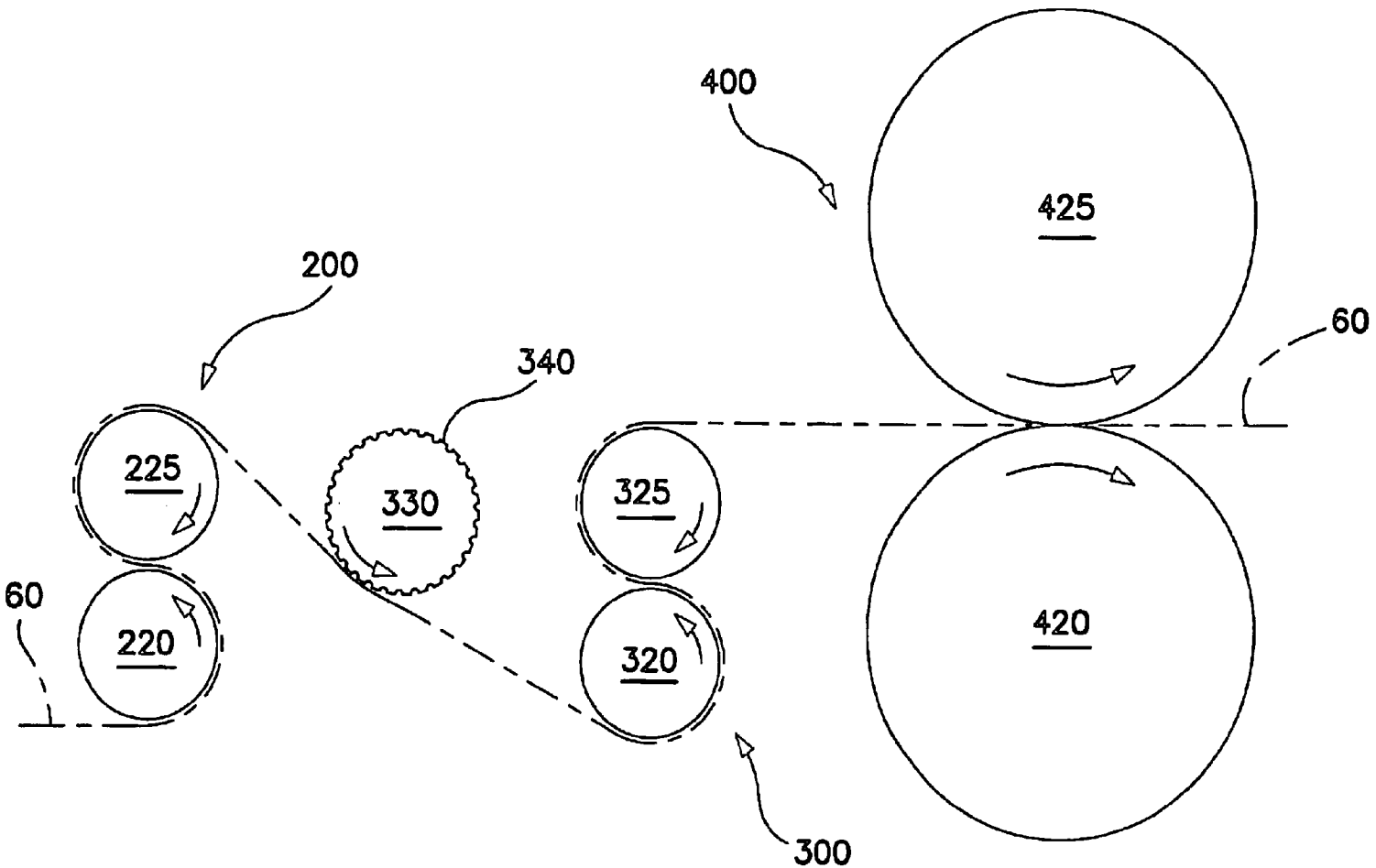
FIG. 2 is a plan view of a web portion between the metering rolls and the pull rolls without any slack in the web.
Figure 3:
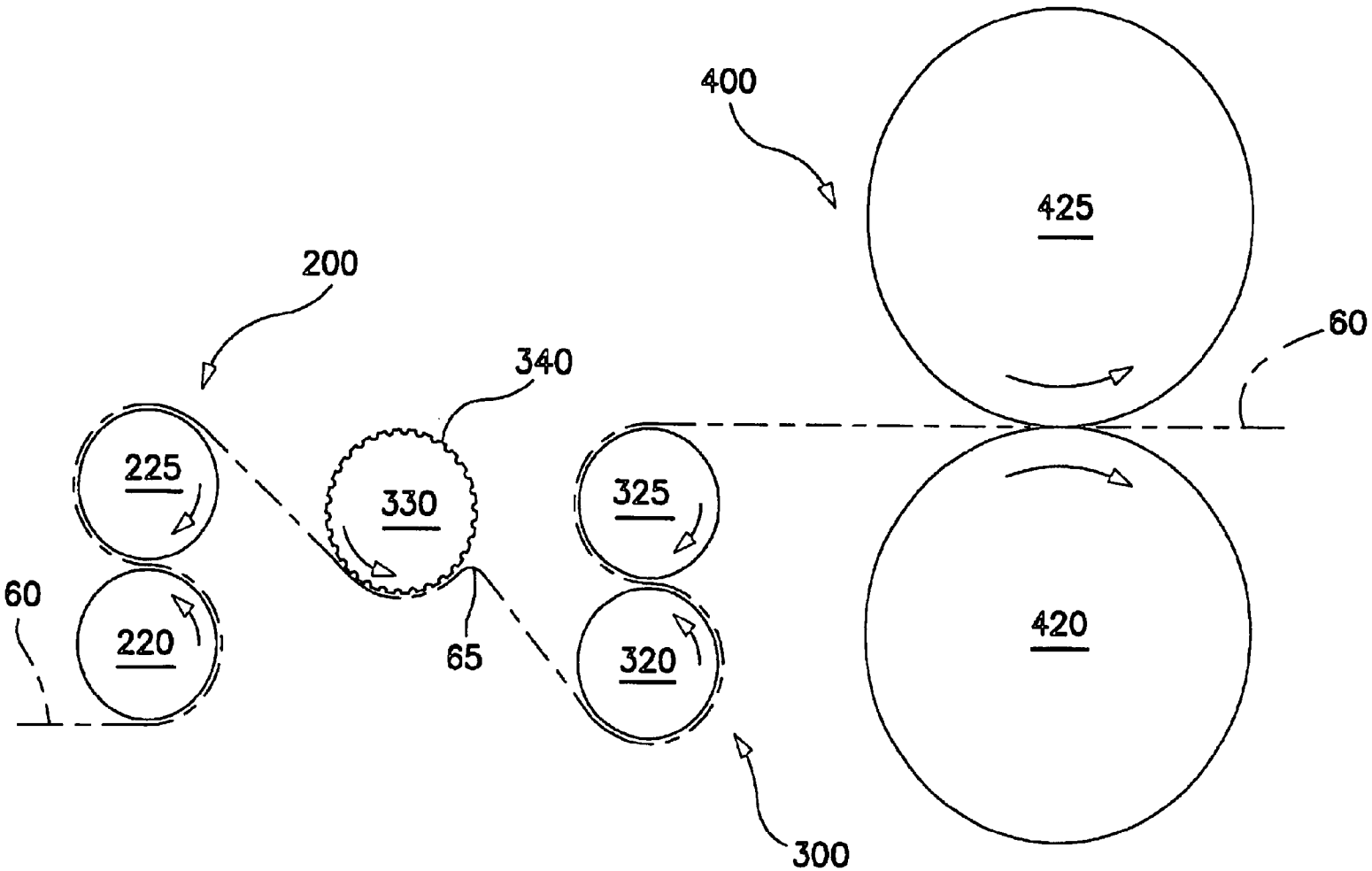
FIG. 3 is a plan view of a web portion between the metering rolls and the pull rolls, with the slack take-up roll holding a festoon of web material.

After the web 60 leaves the rolls of the pull roll station 200, it is fed to the metering roll station 300. As illustrated in FIGS. 2 and 3, the metering roll station is comprised of a pair of metering rolls 320 and 325 and slack take-up roll 330, located between the pull rolls 220 and 225 and the metering rolls. The metering rolls 320 and 325 are rotatably mounted to the frame 20 substantially axially parallel to the pull rolls 220 and 225 and preferably "side-by-side" of one another. The metering rolls 320 and 325 are variably driven to rotate substantially in synchronism with feed rate of the web 60 leaving the pull rolls 220 and 225 of the pull roll station.

Since folded article length is proportional to the length of web material in contact with a given folding cylinder's surface, the minimum length of a folded article can only be as short as the circumference of the given cylinder located between the cylinder's tucker blade and gripper jaws. However, feeding the web 60 to the folding station 400 at a reduced rate to induce slip around a given folding cylinder thus allows a cylinder of given diameter to make a folded web segment having any length shorter than the circumference of the cylinder itself. In the embodiment illustrated in FIGS. 2 and 3, web 60 is fed from the metering station 300 to folding cylinder 420. It is understood however, that web 60 could be fed to cylinder 425 (not shown) as well. The slip of the web about a given cylinder (cylinder 420) thus allows the folding mechanisms to engage the web without the mechanisms having to traverse the rotational distance of the cylinder's outer surface located there-between.

The loop or festoon 65 of web generated during variable speed operation can be controlled by a dancer arm, air blast, vacuum, or any other convenient manner. A preferred loop control device is a take-up roll such as fenestrated take-up roll 330 that utilizes vacuum to control the loop of web material between the pull rolls and the metering rolls.

The take-up roll 330 has a fenestrated outer surface defining a plurality of vacuum holes 340 in fluid communication with a vacuum source (not shown). The vacuum holes 340 thus cause the loop or festoon of web material 65 to be retained on the surface of the take-up roll 330 when the rotation of the metering rolls 320 and 325 slows. The take-up roll 330 is driven to rotate substantially in synchronism with the pull rolls 220 and 225. The take up roll 330 does not speed up or slow down. Thus, as illustrated in FIG. 3, when the metering rolls 320 and 325 slow their rotation, the rotation of the take-up roll 330 takes up the loop or festoon of web material 65 produced by the relatively faster-rotating pull rolls 220 and 225. Any device can drive the metering rolls 320 and 325 and take-up roll 330, and includes electric, hydraulic or pneumatic motors, or any other similar device capable of imparting a rotational motion in a controlled manner.

Figure 4:
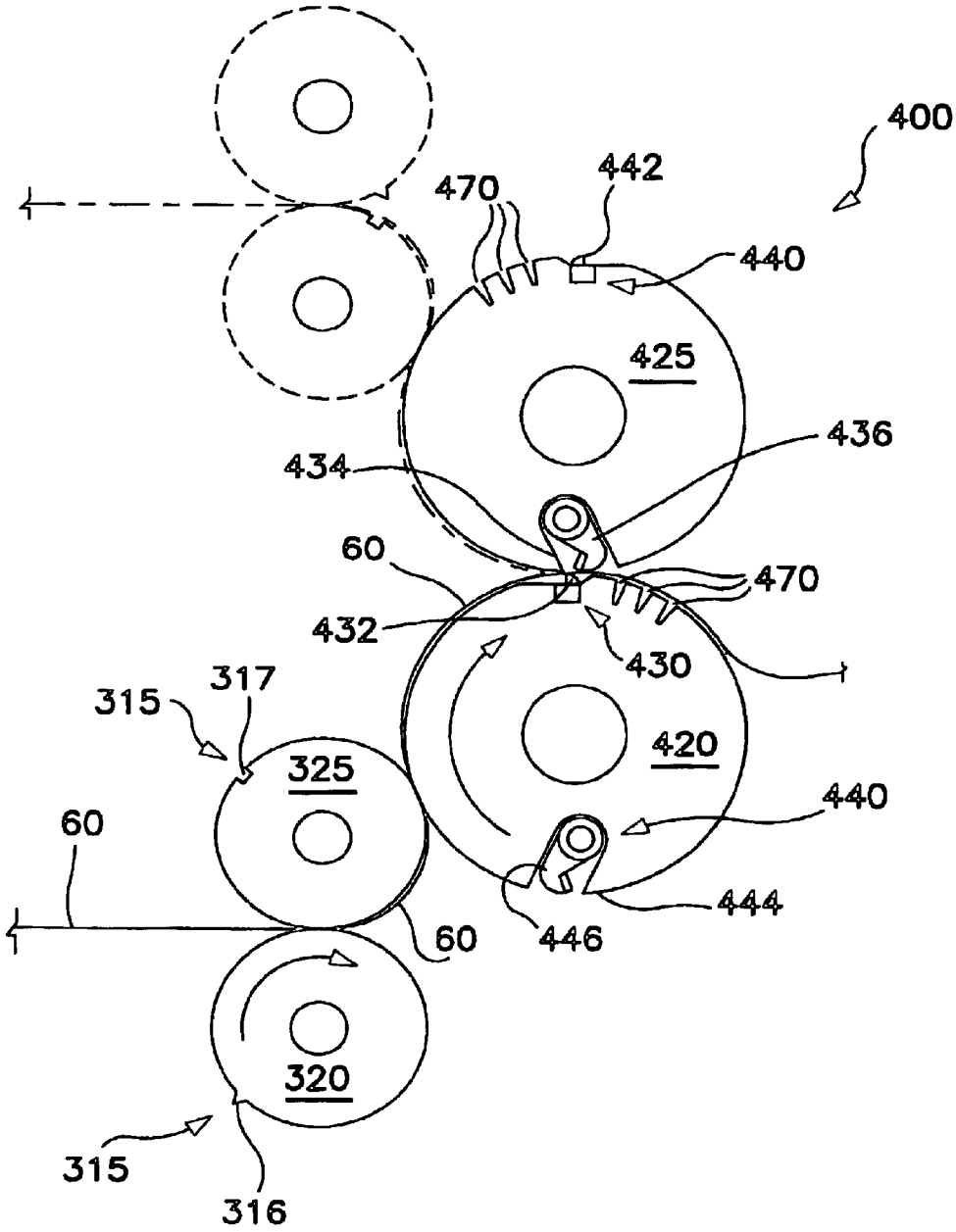
FIG. 4 is a plan view showing a metering roll contiguous with one of the folding cylinders for direct transfer of web to the folding cylinders, the folding cylinder being shown in position for performing a tucking operation.
Figure 5:
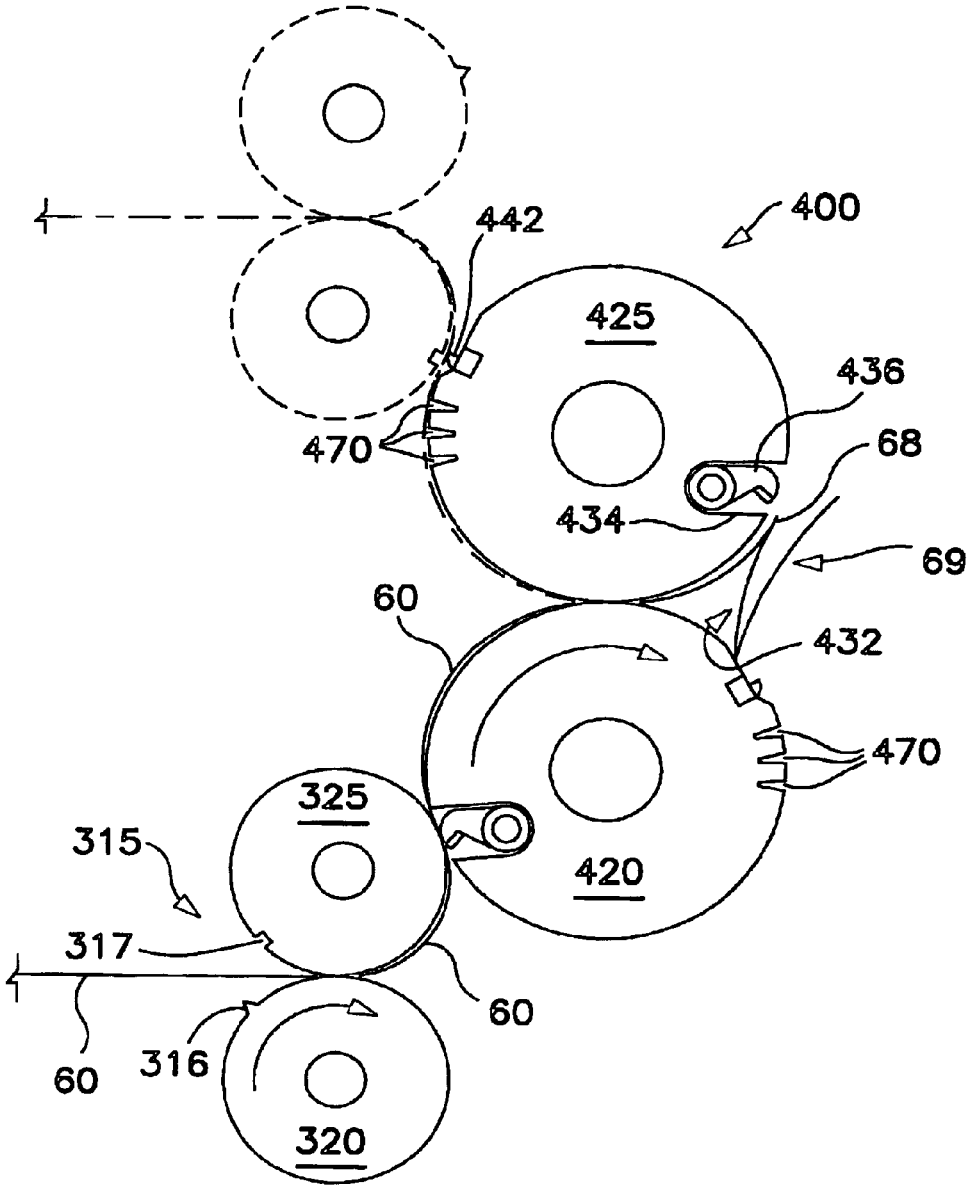
FIG. 5 is a plan view showing a metering roll contiguous with one of the folding cylinders for direct transfer of web to the folding cylinders, the folding cylinder being shown in position for performing a folding operation.

After the web 60 leaves the metering station 300, it proceeds to folding station 400. As illustrated in FIGS. 4 and 5, the folding station 400 comprises a pair of co-acting folding cylinders 420 and 425. The folding cylinders 420 and 425 co-act with one another to perform folding operations on the web 60 to process it into folded segments. Although two folding cylinders are utilized in the preferred embodiment of the invention shown in FIGS. 4 and 5, it is understood that one, two or any number of folding cylinders may be utilized. Furthermore, although two metering rolls 320 and 325 are utilized in the embodiment of the invention shown in FIGS. 4 and 5, it is understood that additional meter rolls may be utilized as well. For example, an additional pair of metering rolls, as illustrated in phantom in FIGS. 4 and 5, may be utilized in a parallel relationship with rolls 320 and 325 if an additional web is to be simultaneously processed by machine 10. With this configuration, the additional web would be processed in parallel to web 60 by the folding station 400.

The folding cylinders 420 and 425 of folding station 400 are rotatably mounted to the frame 20 and driven in synchronism with one another and with the web feed rate of the web 60 leaving the pull rolls 220 and 225 of the pull roll station 200. The folding cylinders of FIGS. 4 and 5 are preferably axially parallel with the rolls of both the pull roll and the metering stations. In one embodiment of the invention, at least one of the folding cylinders is contiguous with at least one of the metering rolls to facilitate the direct transfer of the web 60 from the metering rolls of the metering station 300 to the folding cylinders of the folding station 400.

In the embodiment shown in FIGS. 4 and 5, metering roll 325 is contiguous with folding cylinder 420. The contiguous relationship between the metering roll 325 and folding cylinder 420 minimizes any open space existing between the respective outer surfaces of the roll and cylinder, is not essential but enables the web to transfer directly from the outer surface of the metering roll to the outer surface of folding cylinder. While metering roll 325 and folding cylinder 420 are contiguous with one another in FIGS. 4 and 5, it is understood that contiguous relationships between the other metering rolls and folding cylinders are possible, so long as such contiguous relationship occurs between rolls in synchronism with one another.

At least one perforator unit 315 may optionally be located on the metering rolls 320 and 325 to create at least one perforated line across the web 60 to facilitate the separation of the web along the perforated lines into individual articles. In the embodiment of the invention shown in FIGS. 4 and 5, the perforator unit 315 may comprise a perforator blade 316 located on metering roll 320 that co-acts with a perforator anvil 317 located on co-acting metering roll 325. As the metering rolls 320 and 325 rotate with the web 60 between them, the perforator blade 316 of metering roll 320 presses the web 60 against the perforator anvil 317 of metering roll 325 to create the perforated line across the web 60. While FIGS. 4 and 5 illustrated the perforator blade 316 located on metering roll 320 and the perforator anvil 317 located on metering roll 325, it is understood that blade 316 may be located on roll 325 while anvil 317 is located on roll 320 as well. It is further understood that either the blade 316 or anvil 317 may be located on metering roll 325 while the co-acting blades or anvils may be located on folding cylinder 320, which is contiguous with roll 325.

Referring again to FIGS. 4 and 5 the folding operations by folding cylinder 420 and 425 are achieved through the use of one or more co-acting tucker and gripper sets on the folding cylinders. In the embodiment illustrated in FIGS. 4 and 5, folding cylinders 420 and 425 utilize tucker and gripper sets 430 and 440, respectively, with each set comprising a tucker blade and fixed and moving gripper jaws. The tucker blade and gripper jaws of a given set co-act such that, as the web 60 is fed between the cylinders, the tucker blade of the set located on one of the cylinders pushes or "tucks" a portion of the web into the a space existing between the fixed and moving gripper jaws of the gripper of the same set located on the other cylinder.

In the embodiment illustrated in FIGS. 4 and 5, tucker blade 432 of set 430 is located on folding cylinder 420 while fixed and moving gripper jaws 434 and 436 of the same set are located on cylinder 425. Similarly, tucker blade 442 of set 440 is located on folding cylinder 425 while fixed and moving gripper jaws 444 and 446 of the same set are located on cylinder 420. Referring to FIG. 4, as the cylinders 420 and 425 rotate, the tucker blade 432 retracts from between the fixed and moving gripper jaws 434 and 436, with the moving gripper jaw thereafter closing on the mid-portion of web 60 tucked there-between by the blade and thus causing the segment to be held firmly between the fixed and moving gripper jaws.

As the cylinders 420 and 425 continue to rotate, as illustrated in FIG. 5, the material held in the gripper jaws 434 and 436 establish a leading, folded edge 68 of the web segment 60 as the remainder of the web is folded back over itself to create the folded web segment 69. When the cylinders 420 and 425 reach a predetermined rotational position, the moving gripper jaw 436 opens and the folded edge of the web material is released. Upon further rotation of the cylinders 420 and 425, another web portion 60 is deposited on the folding cylinder 420 by the metering cylinder 325, with corresponding tucker blade 442 tucking the newly deposited web portion material into a space between the corresponding fixed and moving gripper jaw 444 and 446 to repeat the folding process.

Figure 6:
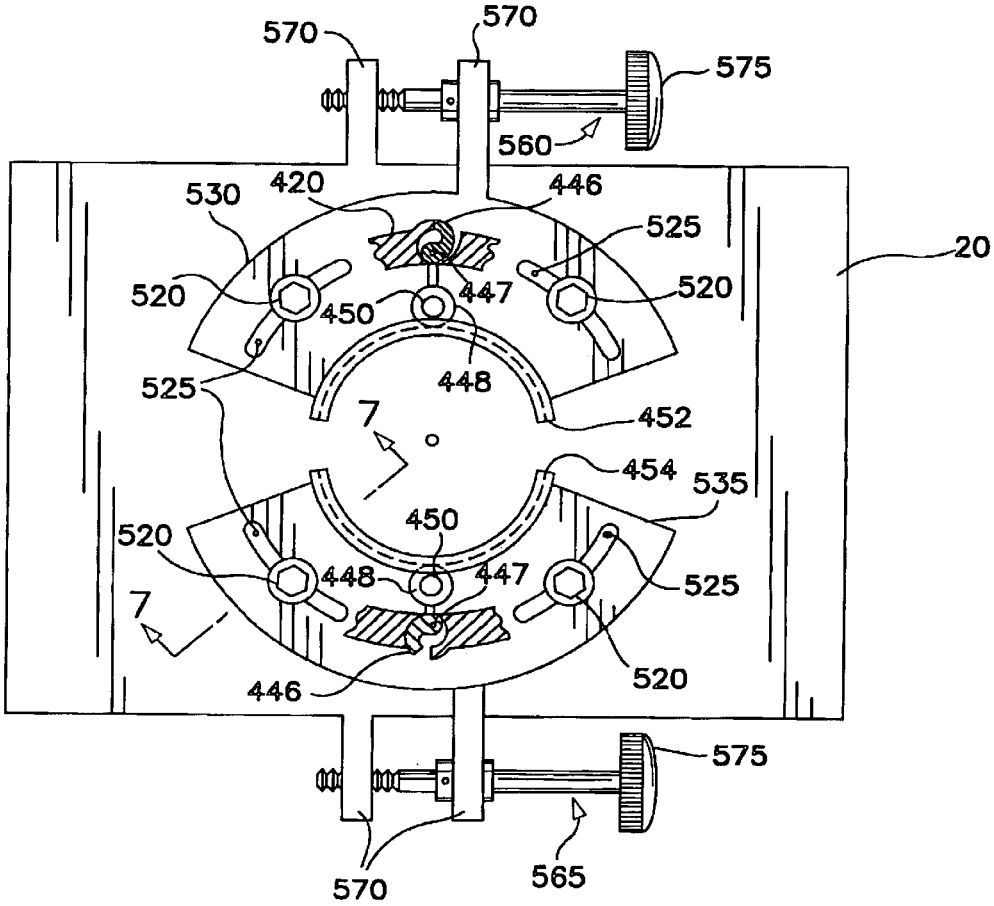
FIG. 6 is a side view of the adjustable cams and follower for the moving gripper jaw of a folding cylinder with the gripper jaw and a portion of the folding cylinder shown in section in both open and closed locations above the respective open and closed jaws.

In the preferred embodiment of the machine, the moving gripper jaws of folding cylinders 420 and 425 are cam-driven to open and closed positions. It is understood, however, that the moving gripper jaws may also be spring-biased to an open or closed position. FIG. 6 shows the cam and follower components of the moving gripper jaw 446 of cylinder 420. For clarity of illustration, gripper jaw 446 and a portion of cylinder 420 is shown in section, with such gripper jaw and cylinder portion illustrated in both closed and open positions on respective closing and opening cams 452 and 454. While the cam and follower components of the moving gripper jaw 436 of cylinder 425 are not illustrated, it is understood that the structure and relationship of those components are the same as those illustrated in FIGS. 6 and 7 for the moving gripper jaw 446.

As illustrated in FIG. 6, closing and opening cam followers, 448 and 450 respectively, rotatably attached to the moving gripper jaw 446, follow respective closing and opening cams 452 and 454, attached to the frame 20, as the cylinder 420 rotates about the cams. While one closing cam and follower and one opening cam and follower are illustrated in FIG. 6, it is understood that one, two, or any number of closing and opening cams and followers could be utilized as well. As illustrated near the top of FIG. 6, a rotation of the cylinder 420 about the cams 452 and 454 causes the closing cam follower 448 to engage the surface of the closing cam 452, thus pivoting the moving gripper jaw 446 about pin 447 to a closed position. A further rotation of the cylinder 420 about the cams 452 and 454, as illustrated near the bottom of FIG. 6, causes the closing cam follower 448 to disengage the surface of the closing cam 452 and the opening cam follower 450 to engage the surface of the opening cam 454, thus pivoting the moving gripper jaw 446 about pin 447 to the open position.

Figure 7:
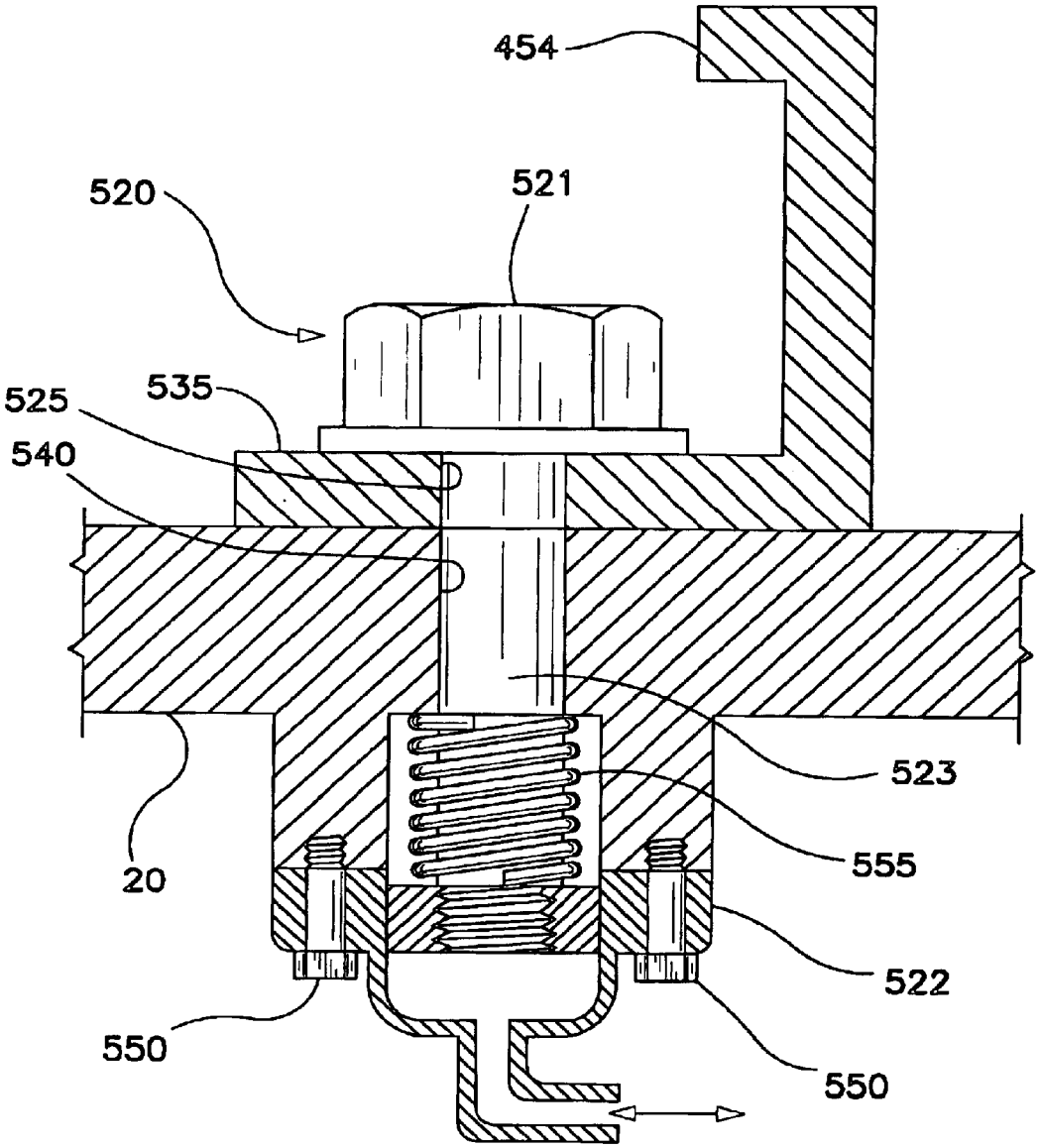
FIG. 7 is a sectional view of a hydraulically locking bolt for one of the gripper jaw cams taken along plane 7—7 in FIG. 6.

The rotational location of the closing and opening cams 452 and 454 in relation to the folding cylinder 420 thus dictates when the moving gripper jaw 446 will open and close during the rotation of the cylinder. FIG. 6 also illustrates the adjustable features of the cams while FIG. 7 illustrates a sectional view of the locking bolts of FIG. 6. While the adjustable cams and locking bolts of the moving gripper jaw 436 of cylinder 425 are not illustrated, it is understood that the structure and relationship of those components are the same as those illustrated in FIGS. 6 and 7 for the moving gripper jaw 446. The rotational locations during which the moving gripper jaws 446 closes and opens are adjustable during cylinder rotation through an operational adjustment of the locations of the closing and opening cams 452 and 454 in relation to the cylinder 420.

Referring again to FIG. 6, which illustrates the adjustable cams of the rotating cylinder, the operational adjustment of the location of the closing and opening and closing cams 452 and 454 during cylinder rotation is enabled by their adjustable connection to the frame 20 with spring-biased, hydraulic locking bolts 520. The spring-biased locking bolts 520 extend through radial slots 525, defined in the cam plates 530 and 535 of respective closing and opening cams 452 and 454, and through respective bores 540 defined in the frame 20.

FIG. 7 illustrates a cross-sectional view of a bolt 520 and cam 454 taken across plane 7—7 of FIG. 6. Each bolt 520 has a bolt head 521 located at one end and a coupler 522 threaded to its opposite end. The bolt head 521, located adjacent to the cam plate 535 of cam 454, holds the cam plate against an inner surface of the frame 20. The shaft 523 of the bolt 520 extends from the bolt head 521, through the radial slot 525 of the respective cam plate 535, through the bore 540 of the frame 20, and beyond an outer surface of the frame to the threaded coupler 522. The threaded coupler 522 is both threaded to the bolt 520 and affixed to the frame 20. In the embodiment shown in FIG. 9, the coupler is affixed to the frame via bolts 550. It is understood, however, that the threaded coupler may be affixed to the frame with screws, rivets, welds, or other similar fastening means understood in the art.

A compression spring 555 is located between an inner surface of the coupler 522 and the outer surface of the frame 20 to forcibly hold the bolt head 521 against the cam plate 535 and the cam plate against the inner surface of the frame 20. The outer surface of the coupler 522 is connected to a hydraulic actuator (not shown). When actuated, the actuator forces hydraulic fluid against the outer surface of the coupler 522, with the coupler exerting a force on the shaft 523 of the bolt 520 to counteract the force of the spring 555, thus displacing the bolt head 521 away from the cam plate 535 and loosening the cam 454 from the frame 20. Although a hydraulic actuator is used to exert a force on the coupler 522, it is understood that other mechanisms may be used to exert the force, to include pneumatic actuators, solenoids, servos, or any other force inducing mechanism understood in the art.

In their loosened state, the radial location of the cams 452 and 454 can be readily adjusted in relation to the frame 20 by shifting them about the bolt shafts via the radial slots 525 to facilitate a timing adjustment of the cams themselves. Referring again to FIG. 6, the shifting of the closing and opening cams 452 and 454 about the bolt shafts via the radial slots 525 is achieved by adjusting the respective closing and opening cam adjustment links 560 and 565. The closing and opening cam adjustment links 560 and 565 threadedly connect the respective closing and opening cam adjustment plates 530 and 535 to the frame 20 via extensions 570. The links can thus be rotated clockwise or counterclockwise to move the cams left or right along their radial slots.

Although the cam adjustment links illustrated in FIG. 6 are rotated via a manually-operated adjustment knob 575, it is understood that the links can also be rotated by an automatically controlled servo motor (not shown) or any similar powered mechanism understood in the art as capable of imparting rotational motion. After the cam location is adjusted, the hydraulic actuator is then de-actuated to release the pressure of the fluid acting against the coupler 522. With the force removed from the coupler 522, the spring 555 again acts to force the bolt head 521 against the cam plate 535, thus again securing the cam 454 to the frame 20.

Figure 8:
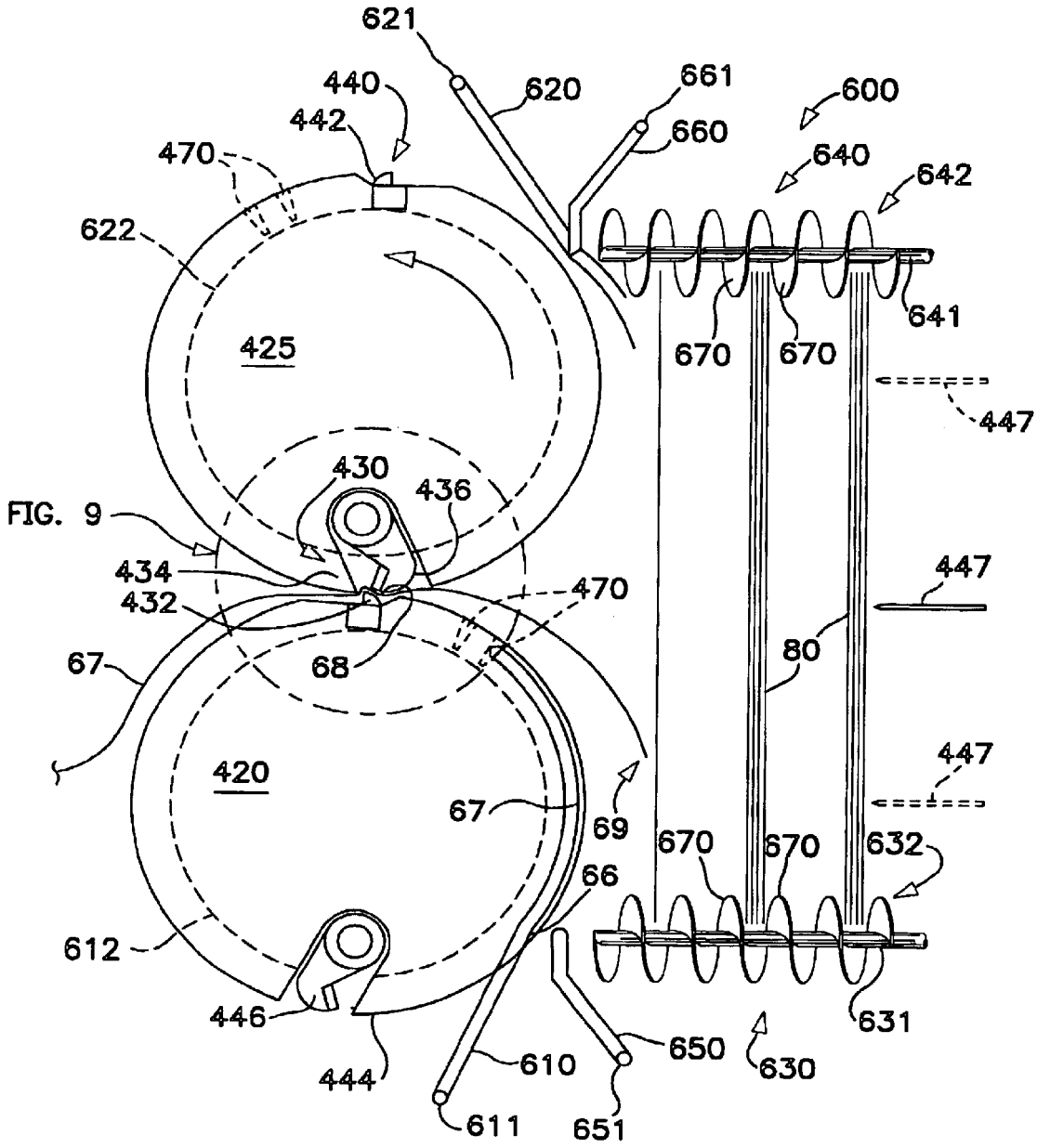
FIG. 8 is a plan view of the folding cylinders and packing station.

Referring now to FIG. 8, in another embodiment of the invention, both the tucker blade and the fixed and moving gripper jaws of each tucker and gripper sets 430 and 440 have a "reduced-radius" protrusion distance from the surface of their respective cylinders 420 and 425, with both the tucker blades 432 and 442 and the fixed and moving grippers jaws 434 and 436 and 444 and 446, respectively, protruding from the surface of the respective cylinders by about only half the distance normally required of a tucker blade that interacts with a gripper mounted flush with a cylinder surface. In the preferred embodiment of the invention, the tucker blades and gripper jaws protrude from their respective cylinders' surfaces by a distance of about 0.375 inches.

Figure 9:
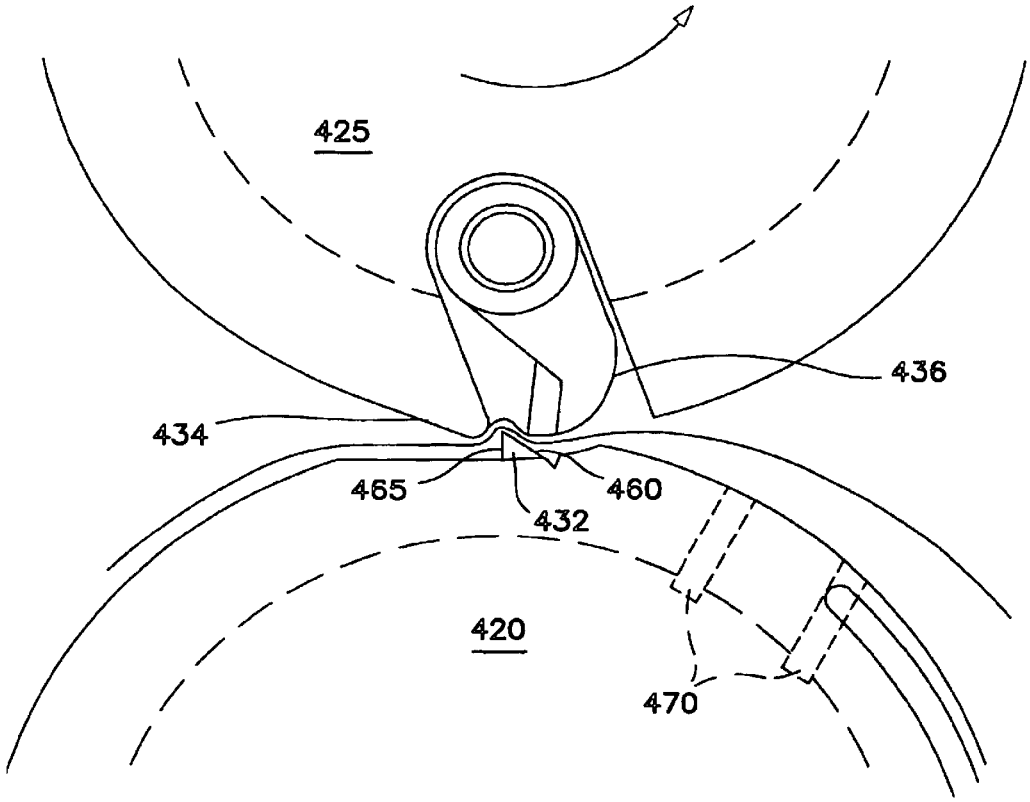
FIG. 9 is a detailed view of a tucker and gripper set of a folding cylinder.

Furthermore, in another embodiment, the position of the tucker blade is fixed in relation to the surface of the cylinder instead of being mounted via a pivoting bearing. The tucker blade can thus be integral with the respective cylinder's surface or affixed to the surface with screws, bolts, or other similar fastening mechanisms understood in the art. The reduction in protrusion distance of the tucker blade reduces the occurrence of unwanted tearing of the web segment 67 overlying the blade itself while the fixed blade position eliminates moving blade parts so that dust and debris have no detrimental effect on cylinder operation. The tucker blade has a cross-sectional profile to enable a "wiping" of a web from the gripper jaw surface to occur. FIG. 9 provides a detailed view of the tucker blade 432 and of fixed and moving gripper jaws 434 and 436 of the tucker and gripper set 430. While the tucker blade 442 and the fixed and moving gripper jaws 444 and 446 of the tucker and gripper set 440 are not illustrated, it is understood that the structure and relationship of those components are the same as those illustrated in FIG. 13 for the tucker and gripper set 430.

Turning to FIG. 9, the tucker blade 432 has a leading face 460 and a trailing face 465, with the leading face leading the trailing face during a rotation of the folding cylinders 420 and 425. The leading face 460, which is proximal to the moving gripper jaw 436 during tucking operations, defines an and angled surface having an angle of about 45 degrees in relation to the cylinder surface while the trailing face 465, which is proximal to the fixed jaw 434 during tucking operations, defines a surface that is approximately perpendicular to the surface of the respective cylinder.

During folding cylinder rotation, the tucker blade 432, having the web laying thereon, is rotated into between the fixed and moving gripper jaws 434 and 436. The angled, leading face 460 of the tucker blade 432 is proximal to the moving gripper jaw 436 while the perpendicular, trailing face 465 is proximal to the fixed gripper jaw 434. Upon further rotation, the moving gripper jaw 436 begins to close onto the fixed gripper jaw 434 as the tucker blade 432 is retracted from between the jaws. The angled face 460 of the tucker blade 432 blade wipes the surface of the moving gripper jaw 436 to ensure that the web 60 remains deposited between the jaws as they close onto the web to created the folded, leading edge 68 of the web segment.

Vacuum ports 470 on folding cylinders 420 and 425 (FIG. 8) pull web material thru between folding cylinders after the gripper is released web material can slip on vacuum ports to provide the proper length accordion-shaped loop downstream of the folding cylinders 420 and 425. The vacuum ports 470 of each cylinder are in fluid communication with a vacuum source (not shown). In the preferred embodiment of the invention, the fluid communication between the vacuum ports 470 and the vacuum source is controlled by an axially mounted, rotary vacuum valve. The rotary vacuum valve enables a fluid communication between the ports and the vacuum source at predetermined rotational locations during the rotation of the cylinders.

Figure 10:
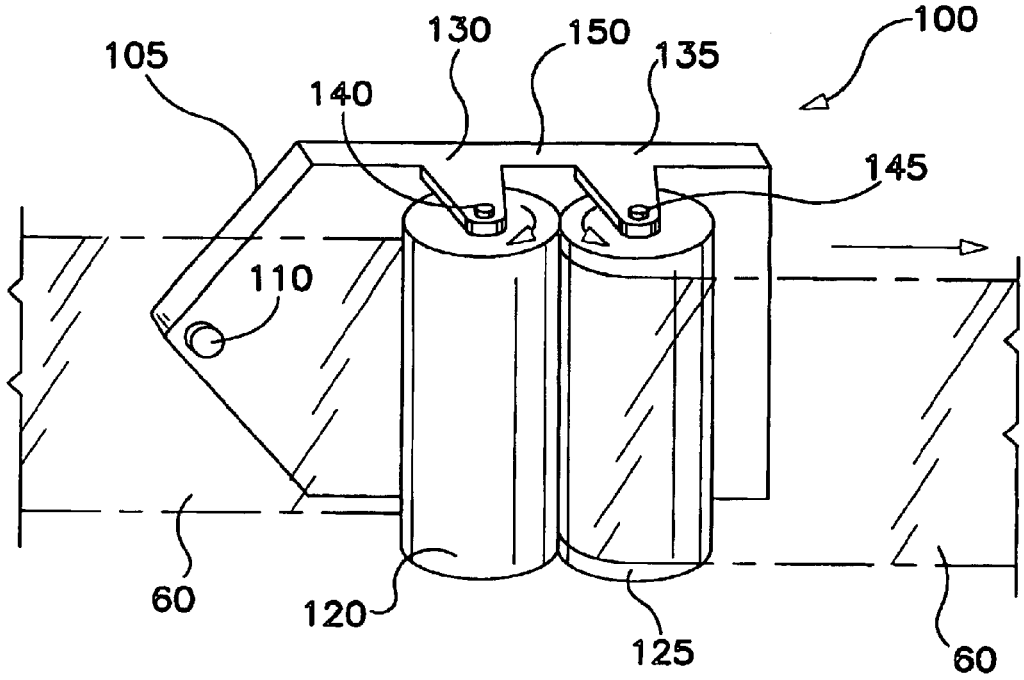
FIG. 10 is a perspective view of the marker roll station in its first, non-pivoted position.
Figure 11:
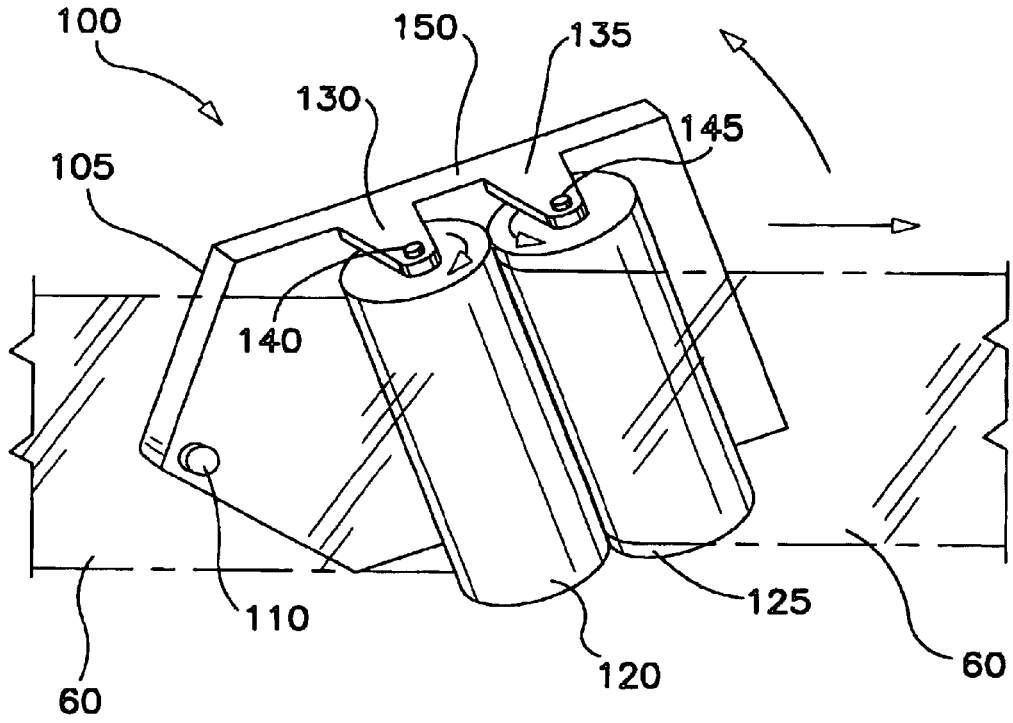
FIG. 11 is a perspective view of the marker roll station in its second, pivoted position.

In another embodiment of the invention, a marker roll station 100 may be movably attached to the frame 20 upstream from the pull roll station 200 as illustrated in FIG. 1. The marker roll station provides two separate functions during operation: that of a web guide and also to mark a predetermined folded product count. The marker roll station 100 is pivotably moveable at a predetermined time from a first, non-pivoted position to a second, pivoted position to vertically displace the feed of web 60 by a predetermined vertical distance, thus creating a marker within the folded segments created by the machine 10. FIGS. 10 and 11 illustrate one embodiment of the marker roll station 100 in the pivoted and non-pivoted positions, respectively. Marker roll station 100 is comprised of a pivoting bracket 105 having at least a pair of marker rolls 120 and 125 rotatably attached thereto. The bracket 105 defines a through bore 110 centrally located proximal to a first end 115 thereof to establish the pivot point of the bracket. The bore 110 encircles a pin or bolt (not shown) extending from the frame 20 to allow the bracket 105 to rotatably move about the pin or bolt in relation to the frame 20.

The marker rolls 120 and 125 are rotatably mounted to respective extensions 130 and 135 of the bracket 105 with axles 140 and 145, the extensions located proximal to the bracket's longitudinal midpoint 150. The marker rolls 120 and 125, positioned axially parallel and adjacent to one another, are preferably positioned "side-by-side" along a longitudinal or lengthwise axis defined by the frame 20 of the machine 10. As illustrated in FIGS. 1 and 10, the axes of the of the marker rolls 120 and 125 lie substantially parallel to the rolls of both the pull roll set 200 and metering roll set 300, and to the cylinders of the folding station 400 when the bracket 105 is located in its first, un-pivoted position.

The marker rolls 120 and 125 are preferably not driven, but instead rotate freely about their respective axles 140 and 145. The marker rolls 120 and 125 thus rotate as the web 60 contacts opposite surfaces of the pivot rolls as it passes through the rolls. When the bracket 105 and marker rolls 120 and 125 of the marker roll station 100 are located in the first, un-pivoted position, as illustrated in FIGS. 1 and 10, the continuous web 60 follows a level, substantially horizontal path that runs parallel with and along a lengthwise, longitudinal axis defined by the machine 10. However, when the bracket 105 is rotated or pivoted about the axis defined by bore 110 to its second, pivoted position, as illustrated in FIG. 11, the marker rolls 120 and 125 are shifted to an angled position in relation to the rolls of both the pull roll set 200 and metering roll station 300, and the cylinders of the folding station 400, with the top ends of the marker rolls 120 and 125 shifting towards the web supply roll 30 and the bottom ends of the marker rolls shifting towards the pull roll station 200.

This shift in position causes the web 60 to displace or shift vertically in an upwardly direction in relation to the frame 20. Thus, with the marker rolls 120 and 125 in this shifted position, the web 60 received by the marker roll station 100 from the web supply 30 remains in its original, lateral position while the web leaving the marker roll station 100 is displaced upwardly of the web received thereby. The upwardly, vertically displaced web is thus fed to the rolls of both the pull roll station 200 and metering roll station 300 and to the cylinders of the folding station 400, with the cylinders of the folding station performing its folding operations on the vertically displaced web. The folding station 400 will thus produce a folded web segment that is vertically displaced in relation to other segments produced while the marker roll station 100 is in its first, un-pivoted position, with the displaced folded segment comprising the marker.

The folding station 400 will thus produce vertically displaced segments as long as the marker roll station 100 remains in its second, pivoted position. The time duration during which the marker roll station 100 remains in its second, pivoted position is predetermined by the machine operator. Although the marker roll station 100 can remain in its second, pivoted position for any time duration, in the preferred embodiment, it remains in the second, pivoted position only long enough for the cutting and folding station 400 to produce one, vertically displaced, folded segment or marker. This marker can thus signify a predetermined quantity of folded web segments produced, with the marker roll station 100 shifting momentarily to produce a vertically displaced segment once during the production of a given predetermined number of folded segments.

The marker roll station 100 can be moved about its pivot point with any motion inducing mechanism understood by one in the art. It can thus be moved by servos, actuators, motors, pneumatic or hydraulic mechanisms, gears, or any similar mechanism. The triggering of the actuator or other mechanism can occur manually, under the control of the operator, or automatically, under the control of an electronic control system understood in the art. The present invention, in utilizing marker rolls 120 and 125 instead of a pivoting folding board to vertically displace the folded product, thus minimizes the likelihood of tearing the web.

In another embodiment of the invention, after the web is folded in the folding station 400, the folded web is then removed from the folding cylinders 420 and 425 of the folding station 400 by the components of the packing station 600. Referring again to FIG. 8, the packing station 600, located down-stream from the folding station 400, is comprised of packing fingers 610 and 620, adjustable-pitch screw separators 630 and 640, and optionally packing assist fingers 650 and 660. Although FIG. 8 illustrates two packing fingers, two screw separators and two packing assist fingers, it is understood that one, two, or any number of packing fingers, screw separators and packing assist fingers may be utilized.

The packing fingers 610 and 620 are preferably pivotably mounted to the frame 20 via pins 611 and 621. The length of each finger 610 and 620 extending from the respective pins 611 and 621 is arcuate to approximate the curvature of the respective folding cylinders 420 and 425. The arcuate lengths of the packing fingers 610 and 620 move into and out of grooves 612 and 622 located within the respective surfaces of the folding cylinders 420 and 425, the fingers pivoting about their respective pins 611 and 621 at predetermined times to remove a folded web segment 69 from the cylinders and place them into respective screw separators 630 and 640.

The packing assist fingers 650 and 660 may optionally be used in combination with the packing fingers 610 and 620 to subsequently hold the folded segments 69 unloaded to the screw separators 630 and 640 by the packing fingers. Like the packing fingers 610 and 620, the packing assist fingers 650 and 660 are pivotably mounted to the frame 20 preferably via pins 651 and 661. The length of each finger 650 and 660 extending from the respective pins 651 and 661 is preferably angled to lay flush with a given folded segment unloaded from the respective folding cylinders 420 and 425. The angled lengths of the packing assist fingers 650 and 660 move into and out of contact with the folded segments unloaded to the respective screw separators 630 and 640 to press the folded segments into the separators, the assist fingers pivoting about their respective pins 651 and 661 in synchronism with the packing fingers to receive the folded web segments.

The packing fingers 610 and 620 and the packing assist fingers 650 and 660 are in synchronism with each other and with the rotation of the folding cylinders 420 and 425. The packing fingers 610 and 610 will remain within the grooves 612 and 622 of the respective cylinders 420 and 425 until a gripper, holding the folded edge 68 of segment 69 therein, rotates past the respective finger. When the gripper jaws open to release the folded segment 69, the respective packing finger pivots out of the groove to move the segment from the cylinder's surface to the respective screw separator.

While the packing fingers 610 and 620 are within the grooves 612 and 622 of the cylinders, the angled packing assist fingers 650 and 660 are adjacent to the segments 69 located within the respective screw separators 630 and 640, pressing against the segments to hold them therein. When a given packing finger pivots out of the groove of the respective cylinder, the respective packing assist finger pivots away from the folded segments 69 within the respective screw separator to enable another segment to be placed there by the packing finger. After the packing finger has placed the additional folded segment 69 into the screw separator and has pivoted back to the groove of the respective cylinder, the packing assist finger pivots back to the screw separator to hold the additional folded segment therein.

In the preferred embodiment of the invention, the packing fingers 610 and 620 and packing assist fingers 650 and 660 are driven by gear-driven cam shaft synchronized with the rotation of the folding cylinders 420 and 425. However, it is understood that the packing fingers and packing assist fingers may also be driven by servos, actuators, or similar motion-inducing mechanisms, with the synchronization of the mechanisms with the folding cylinders being controlled by any automated control system understood in the art.

Referring again to FIG. 8, the screw separators 630 and 640 allow the packing fingers 610 and 620 (and optionally the packing assist fingers 650 and 660) to separate the removed folded segments 69 into individual, variable-count accumulations 80, with the accumulations being located between adjacent flights 670 of the respective screw separators. The screw separators 630 and 640 comprise shafts 631 and 641 having flexible threads 632 and 642 attached thereto, the flexible threads defining the adjacent flights 670.

The shafts 631 and 641 are rotatably mounted to the frame 20, proximal to the folding cylinders 420 and 425. A cutter device such as band saw 447 is mounted for lateral movement and positioned to cut the folded web material in predetermined widths. This arrangement also makes it possible, if desired, to provide a relatively long folded product by cutting off only a very small portion of the material at one of the folds while generating only a limited amount of selvage. The packing fingers can also be utilized to urge the folded portions against the cutter device.

Figure 12:
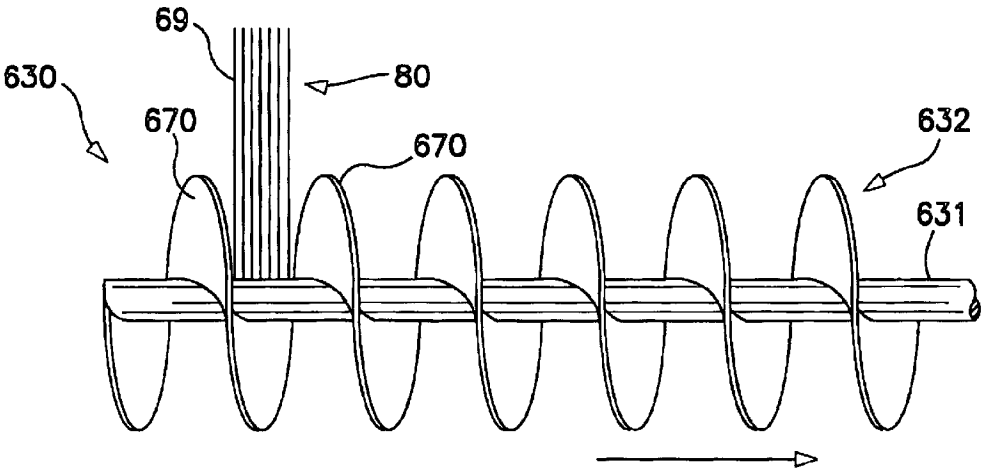
FIG. 12 is a side elevation view of a screw separator of the packing station having an increased pitch.
Figure 13:
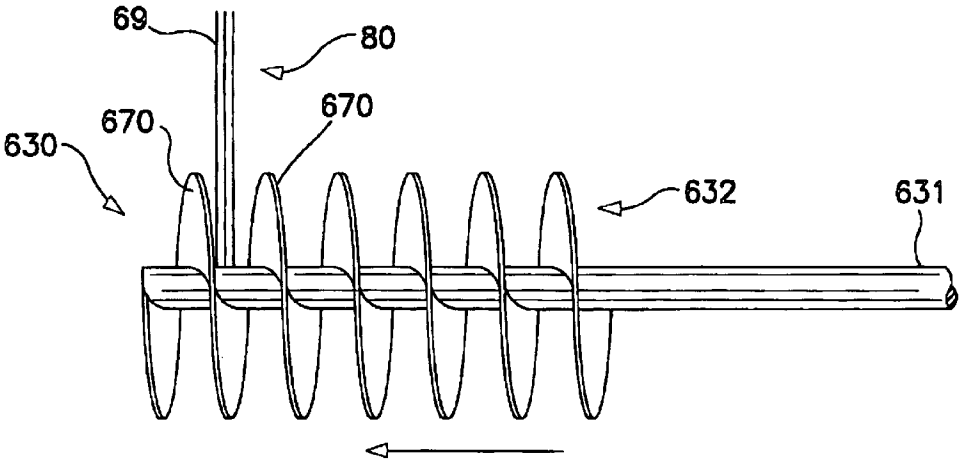
FIG. 13 is a side elevation view of a screw separator of the packing station having a decreased pitch.

FIGS. 12 and 13 illustrate the components the screw separator 630 in more detail. While the detailed components of screw separator 640 are not illustrated, it is understood that the structure and relationship of those components are the same as those illustrated in FIGS. 12 and 13 for screw separator 630. The leading end of the flexible thread 632 is fixably connected to the end of the shaft 631 located proximal to the folding cylinder 420 while the terminal end of the thread is allowed to "float" on the shaft. Because the thread 632 is flexible, it can stretch lengthwise along the shaft 631 to increase the pitch or the distance between adjacent flights 670 of the screw separator 630.

FIGS. 12 and 13 show two variations of the separator 630, each having the same shaft 631 with flexible thread 632 thereon, the thread defining 6 flights 670 for each variation. As illustrated in FIG. 12, an increased pitch (flight-to-flight distance) of the screw separator 630, enabled by the stretched thread 632, thus allows the separator to accommodate an increased accumulation 80 of folded web segments 69 between the adjacent flights 670. Likewise, as illustrated in FIG. 13, the thread 632, in a compressed or un-stretched state, allows the same separator 630 to also accept a reduced accumulation 80 of folded segments 69 between the adjacent flights 670, to include a single segment.

In constant speed operation, the web 60 is pulled over folding board 40 and through a marker roll station 100, located downstream from the web supply, prior to reaching the pull roll station 200. The marker roll station 100 guides web 60 and periodically vertically displaces a portion of the web to create a vertically displaced folded segment or marker within an accumulation of folded web segments created by the folding station.

Figure 14:
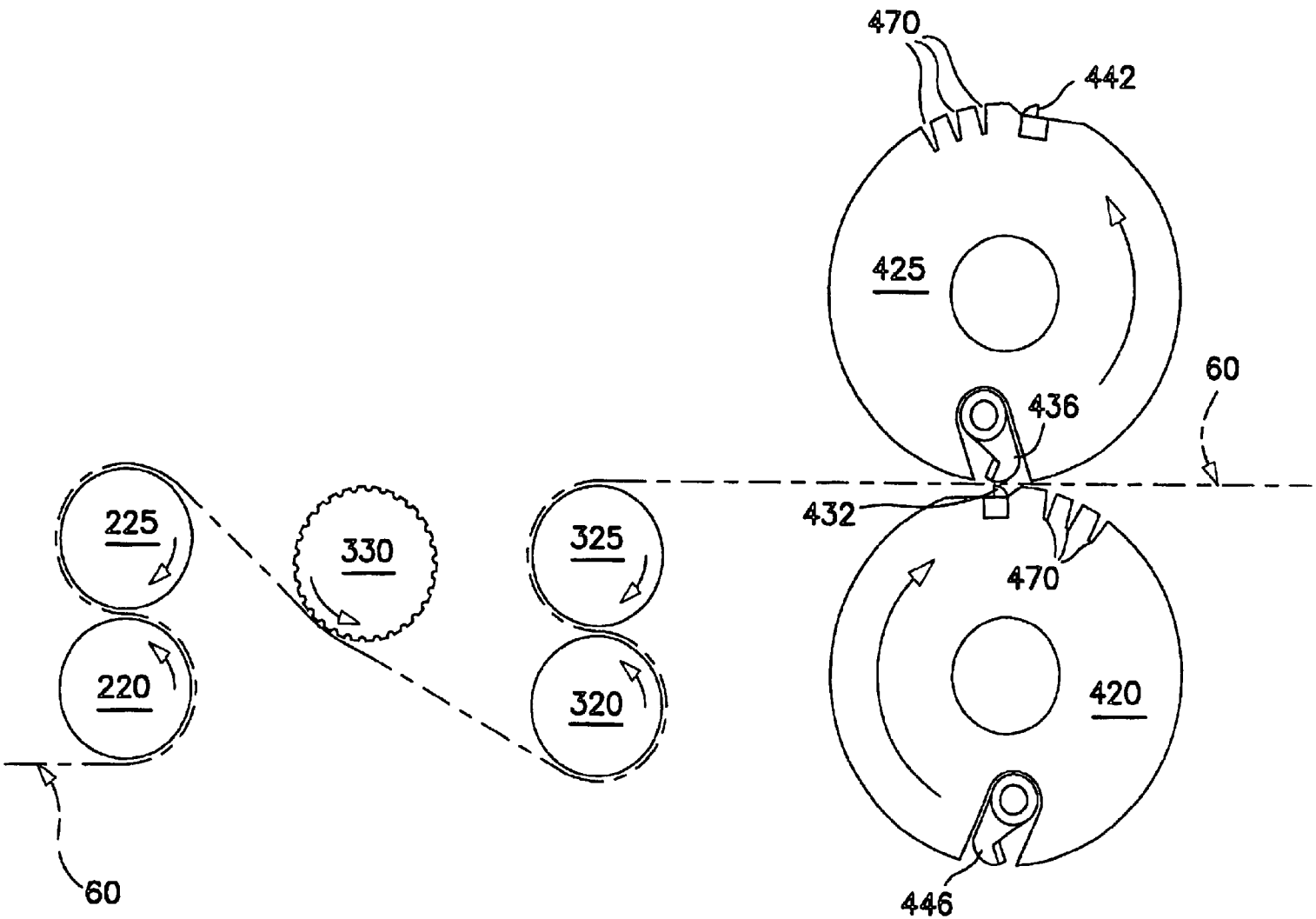
FIGS. 14–18 illustrate schematically a constant speed web folding operation.
Figure 15:
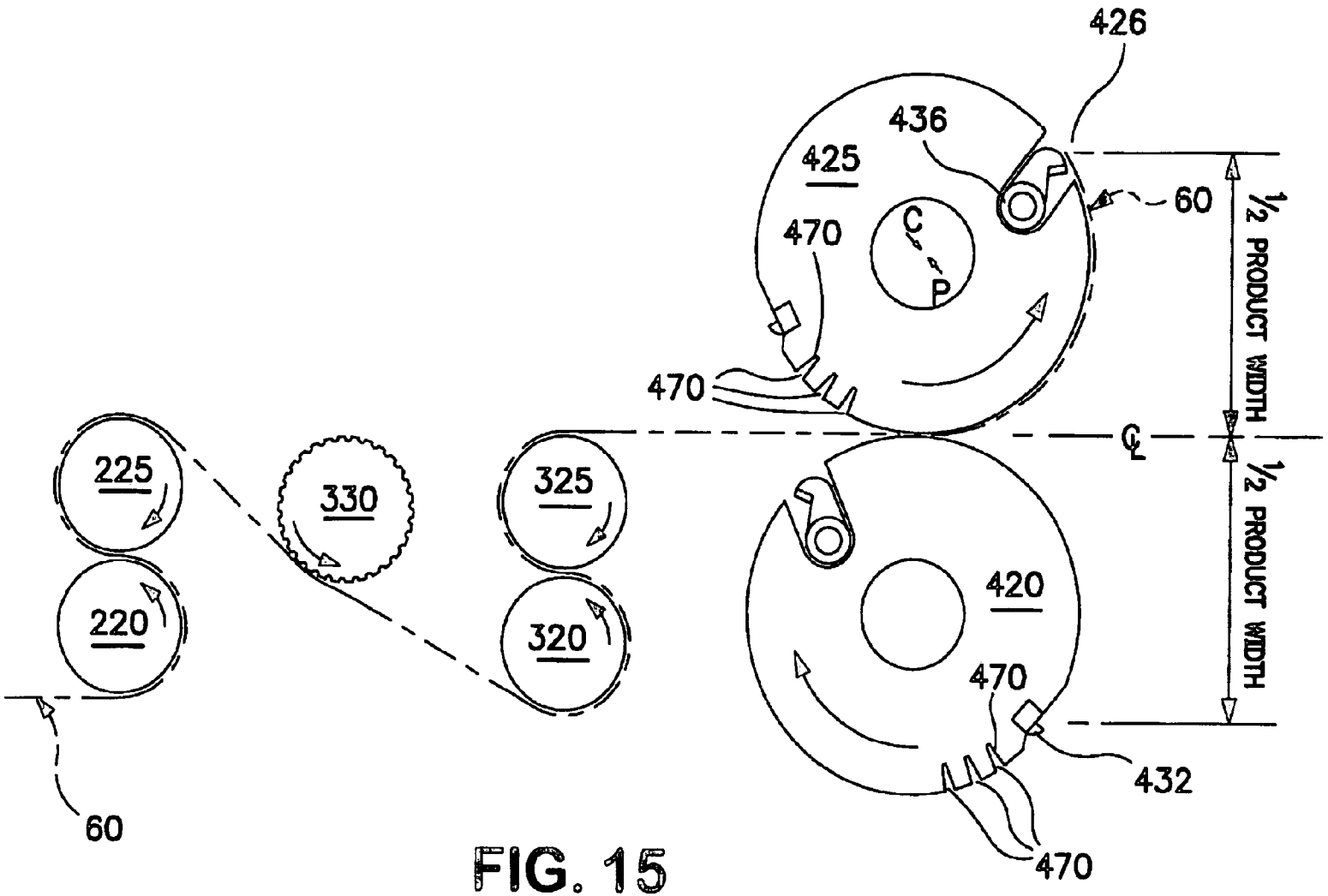

As shown in FIG. 14, web 60 is engaged by pull rolls 220, 225, passes past slack take-up roll 330, if present, wraps around metering rolls 320, 325 and is received between paired folding cylinders 420, 425. The surface speed of the pull rolls 220, 225, the slack take-up roll 330, the metering rolls 320, 325 and the folding cylinders 420, 425 is substantially the same. The tucker 432 on folding cylinder 420 inserts the web material into open moving gripper jaw 436 on a folding cylinder 425. As folding cylinders 420 and 425 rotate, moving gripper jaw 436 closes against fixed gripper jaw 434, holding web material tight against the peripheral surface of folding cylinder 425 (FIG. 15).

Figure 16:
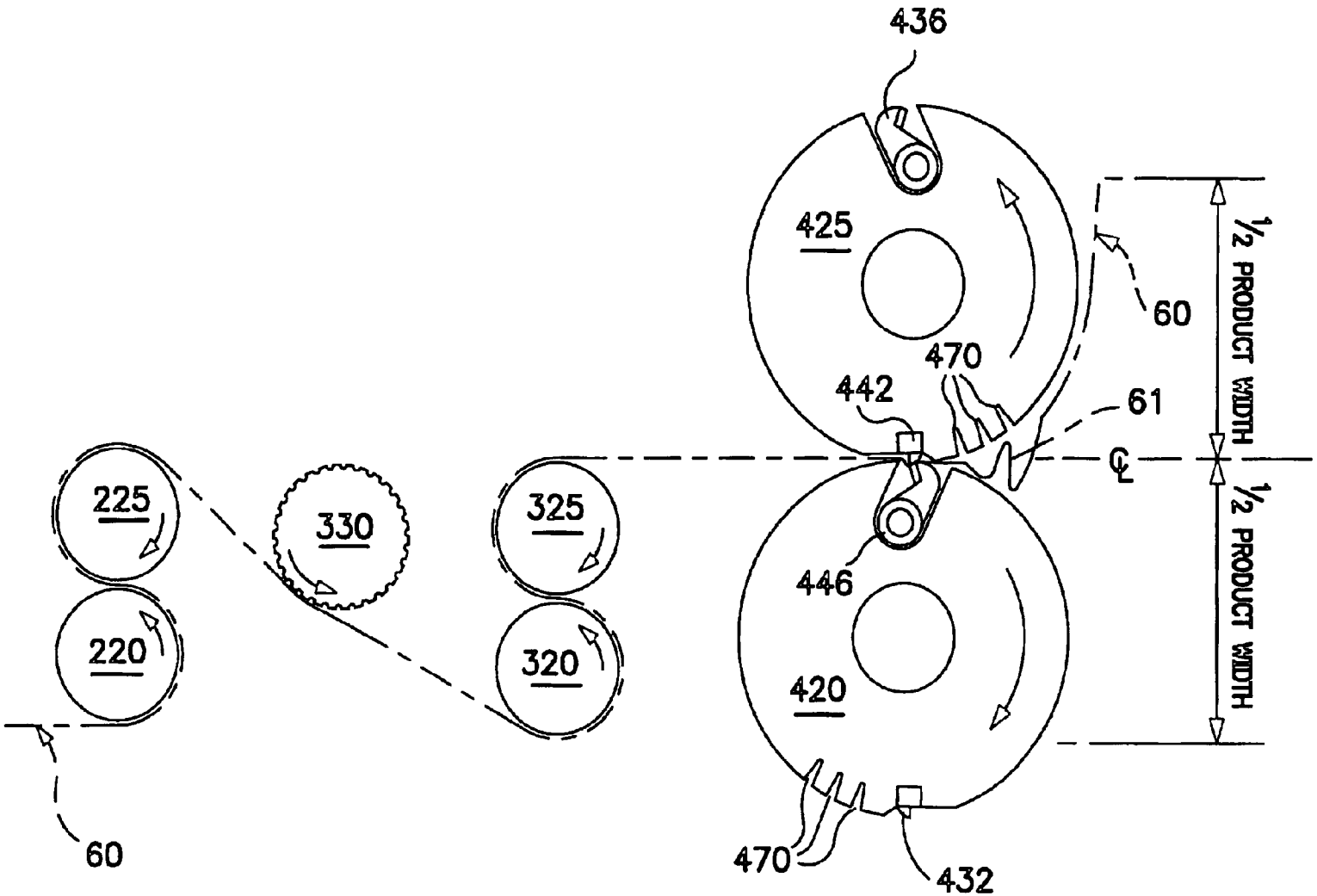
Figure 17:
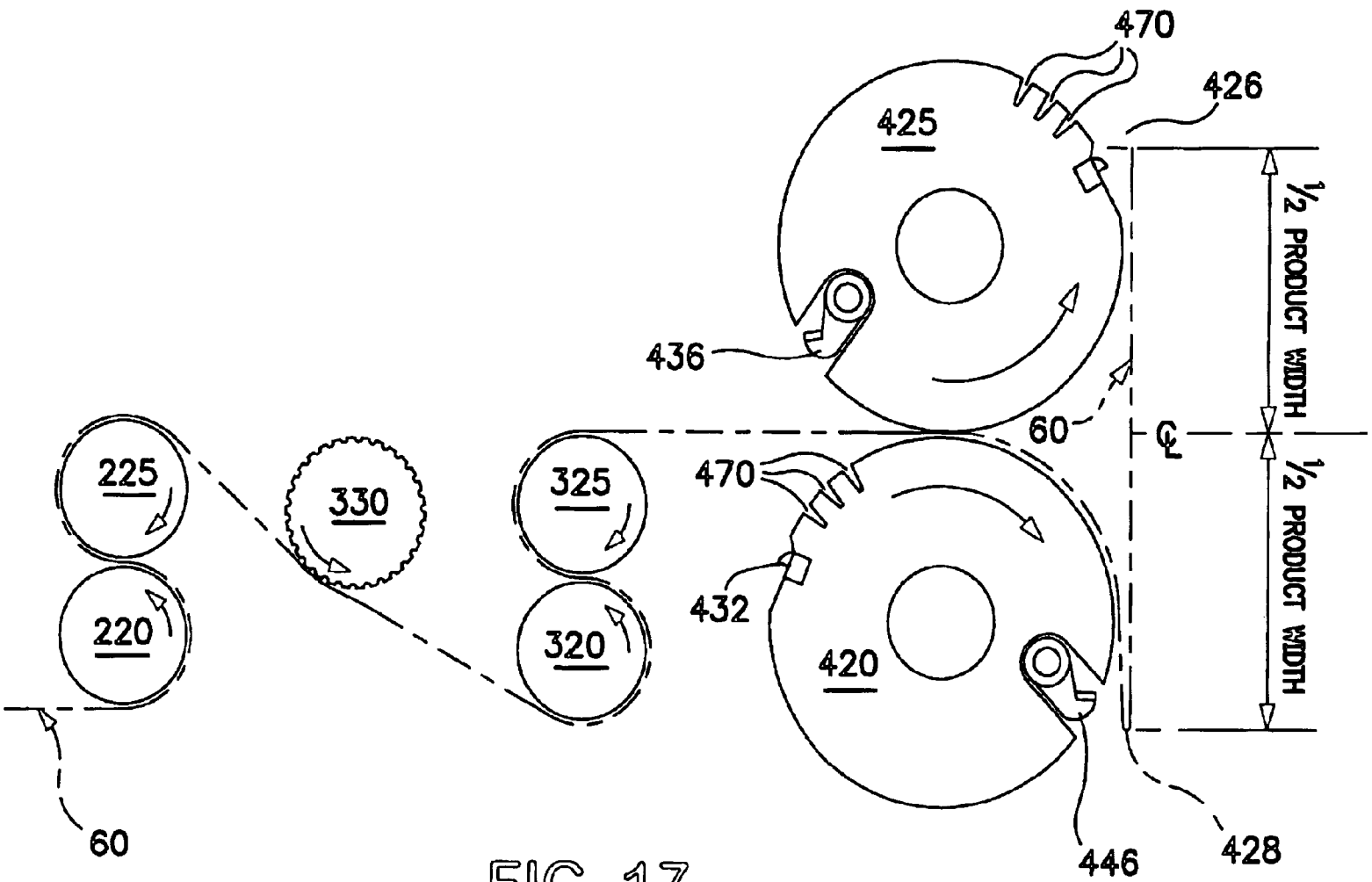

As folding cylinders 420, 425 rotate and the web material is pulled to a predetermined drop-off point 426 situated one-half of the folded product with from the machine centerline, moving gripper jaw 436 releases the web material. Web 60 is pulled through folding cylinders 420 and 425 with the assistance of vacuum applied through vacuum ports 470 and forms an accordion-shaped, pleated portion 61 (FIG. 16) until the next tucker-gripper interaction straightens the pleated portion 61 and produces a fold at the release point 428 (FIG. 17). The distance between release points 426 and 428 represents the width of the folded product and is equal to one half of the folding cylinder 420, 425 circumference.

Figure 18:
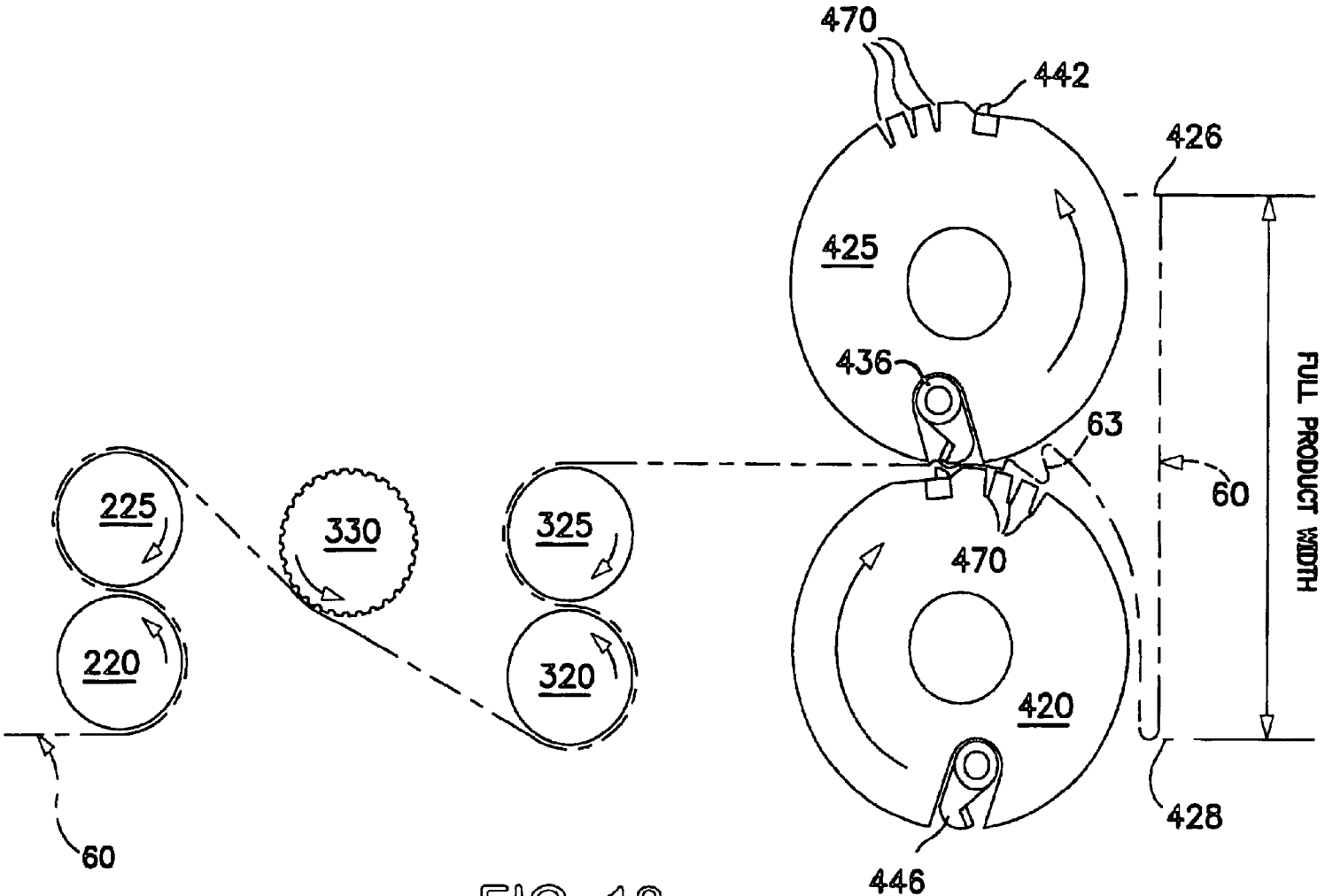

As the folding cylinders 420, 425 continue to rotate, another accordion-shaped, pleated portion 63 of web 60 is formed (FIG. 18). Pleated portion 63 is then pulled to release point 426 by the next tucker-gripper interaction. Repeated rotations of folding cylinders 420, 425 generate a continuous stream of zig-zag folded material. Packing fingers then remove the folded web segments from the folding cylinders 420, 425 and place them between adjacent flights of the adjustable-pitch a screw separator 600 of packing station. The above steps are then repeated at least once to create an accumulation of two or more folded web segments between the flights. After a predetermined accumulation of folded segments are placed between the empty flights of the respective screw separators, the screws are rotated to remove the accumulation and to position subsequent empty flights for placement of additional folded segments there-between.

Figure 19:
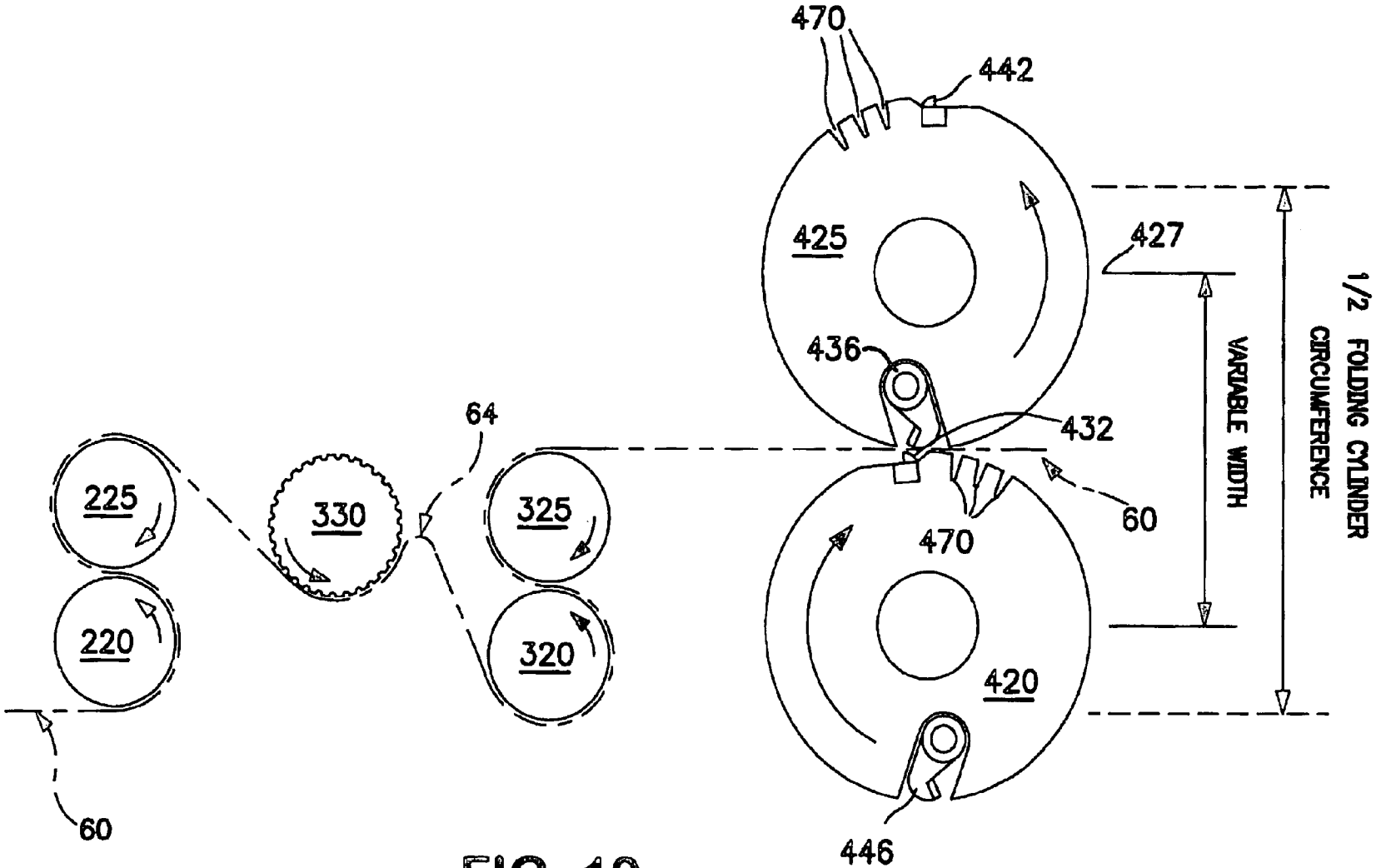
FIGS. 19–24 illustrate schematically a variable speed web folding operation.

Variable length operation of the present web folding machine is illustrated by FIGS. 19–24. Referring in particular to FIG. 19, web 60 is fed to pull rolls 220, 225 as described hereinabove. These pull rolls operate at a surface speed which is relatively slower than that of the folding cylinders. The speed ratio of the pull rolls to that of the folding cylinders is the ratio of the desired folded product with to one-half of the folding cylinder circumference.

When a gripper on the folding cylinder closes on the web material during a variable speed operation, the speed of the web material must match the surface speed of the folding cylinders as well as the surface speed of the metering rolls. During the time period that the moving gripper jaw 436 pulls the web material around to a predetermined drop-off point 427, more web material is being pulled than the relatively slower, constant velocity pull rolls are providing of that time. A loop or festoon 64 of extra web material is therefore provided between slack take-up roll 330 and the metering rolls 320 and 325. The length of web material 60 extending from the contact point with both folding cylinders 420 and 425 to the drop-off point 427 (FIG. 20) equal to the length of material supplied by the pull rolls 220, 225 plus the length of material "stored" in loop 64.

Figure 20:
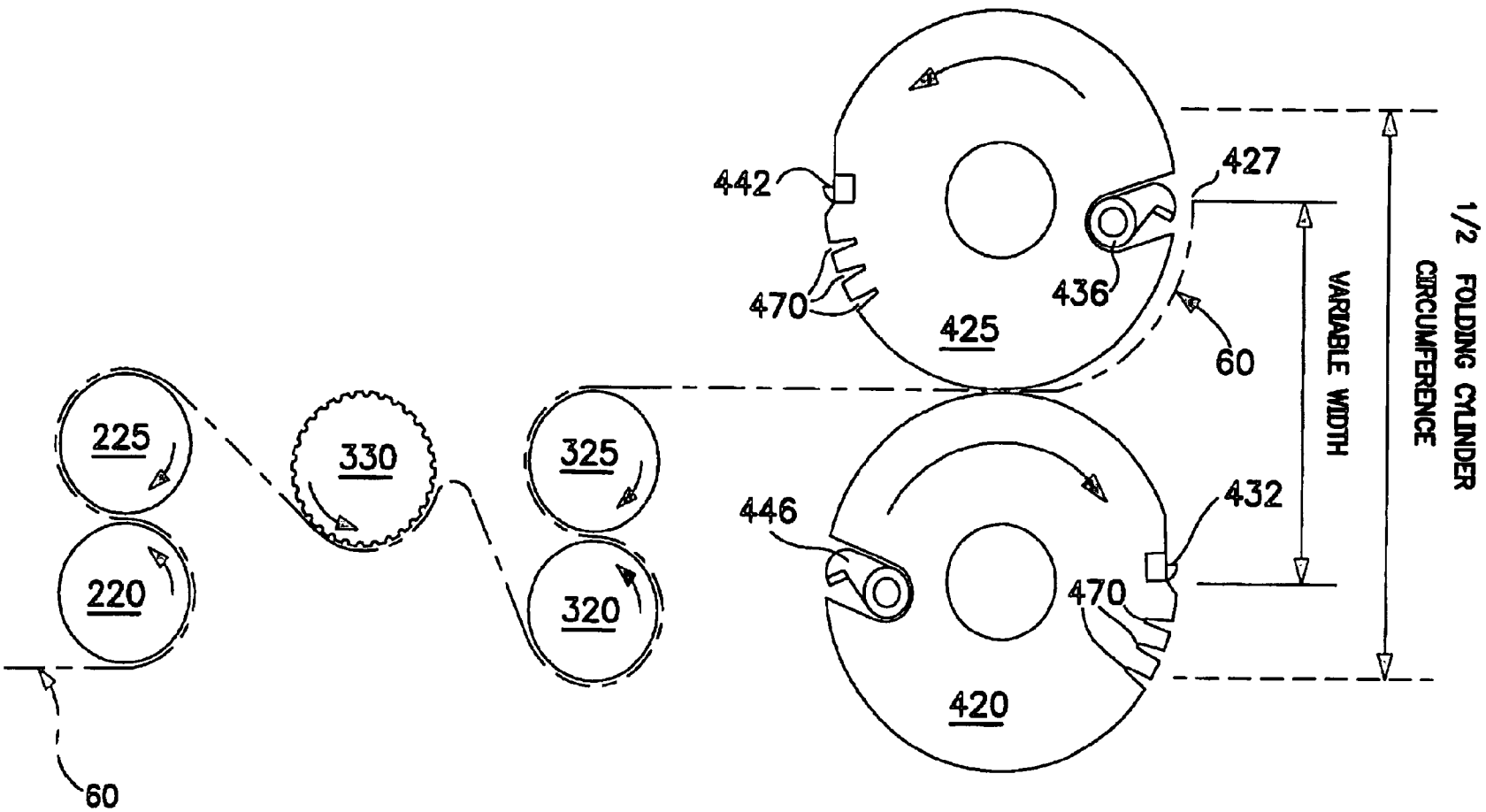
Figure 21:
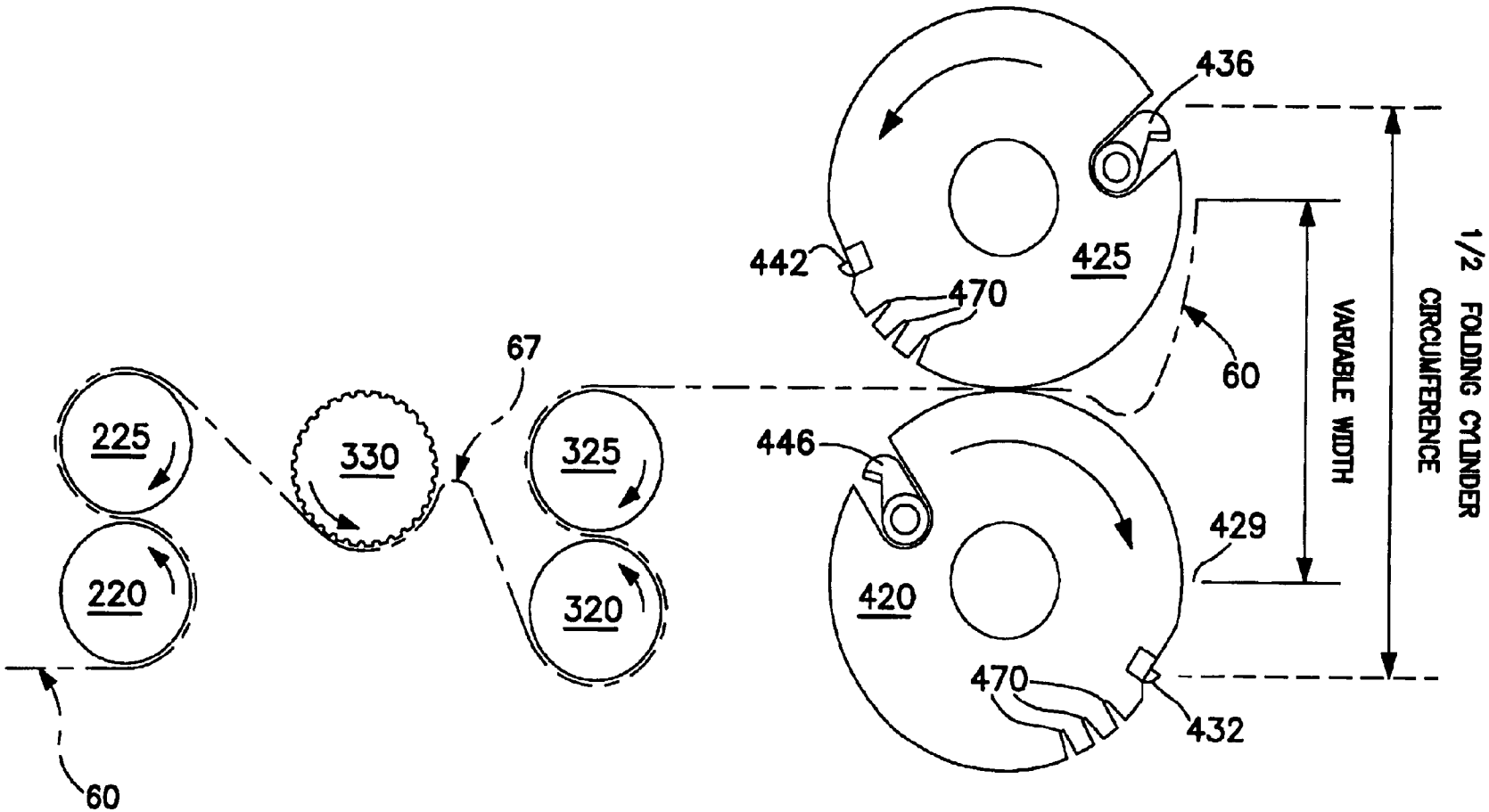
Figure 22:
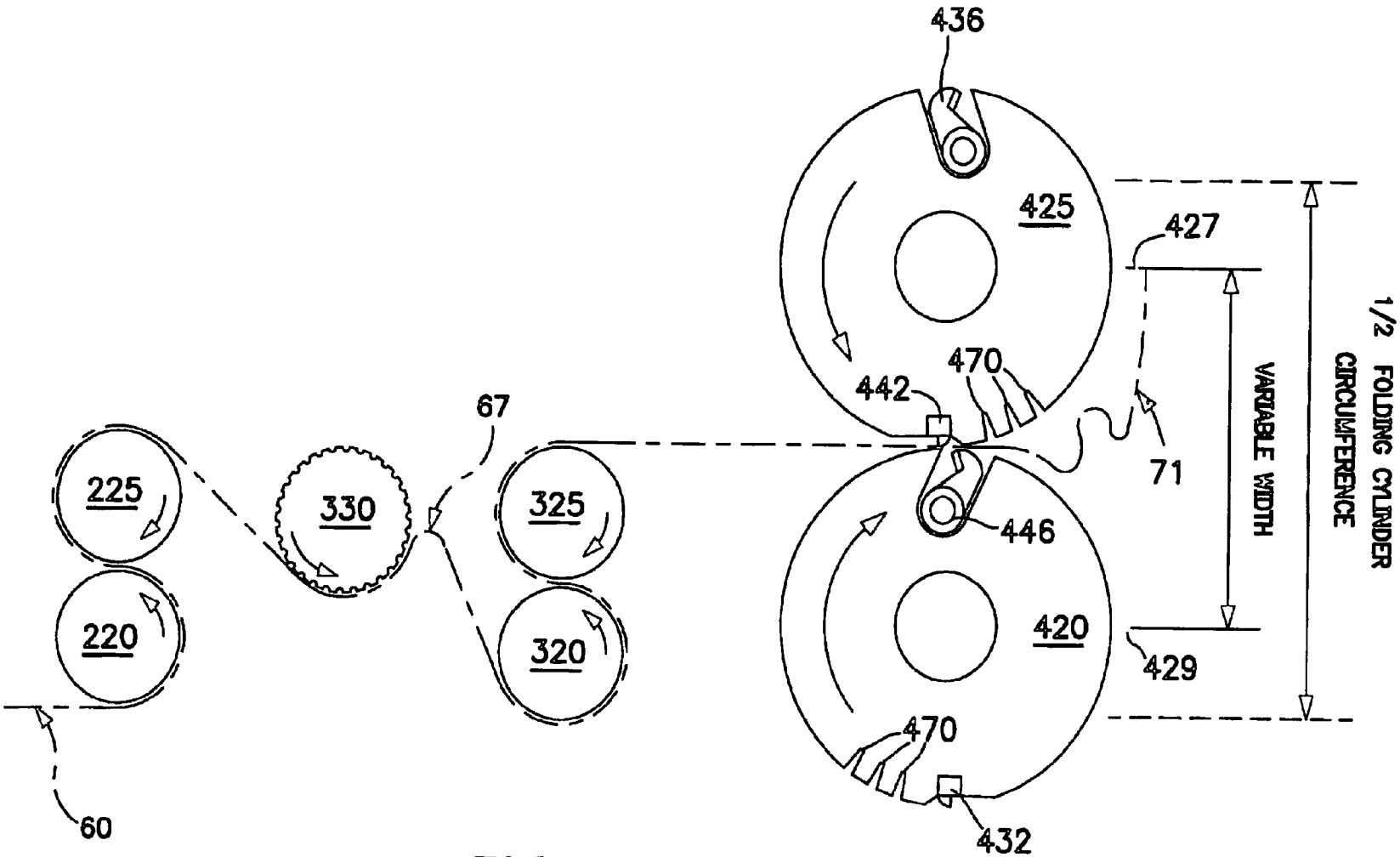

Just after the moving gripper jaw 436 has released the web material at drop-off point 427 as shown in FIG. 20, the metering rolls 320, 325 slow down to a surface speed below that of the pull rolls 220, 225 and the folding cylinders 420, 425. This causes the web material to slip, passing through the nip of folding cylinders 420, 425 and past the vacuum ports 470 associated therewith, while a new loop or festoon 67 is formed (FIG. 21). During this slippage period, the amount of web material that passes through the nip of the folding cylinders 420, 425 is substantially equal in length to one width of the produced folded product (FIG. 22). Vacuum ports 470 can provide variable negative pressure so as to control the degree of slip.

Figure 23:
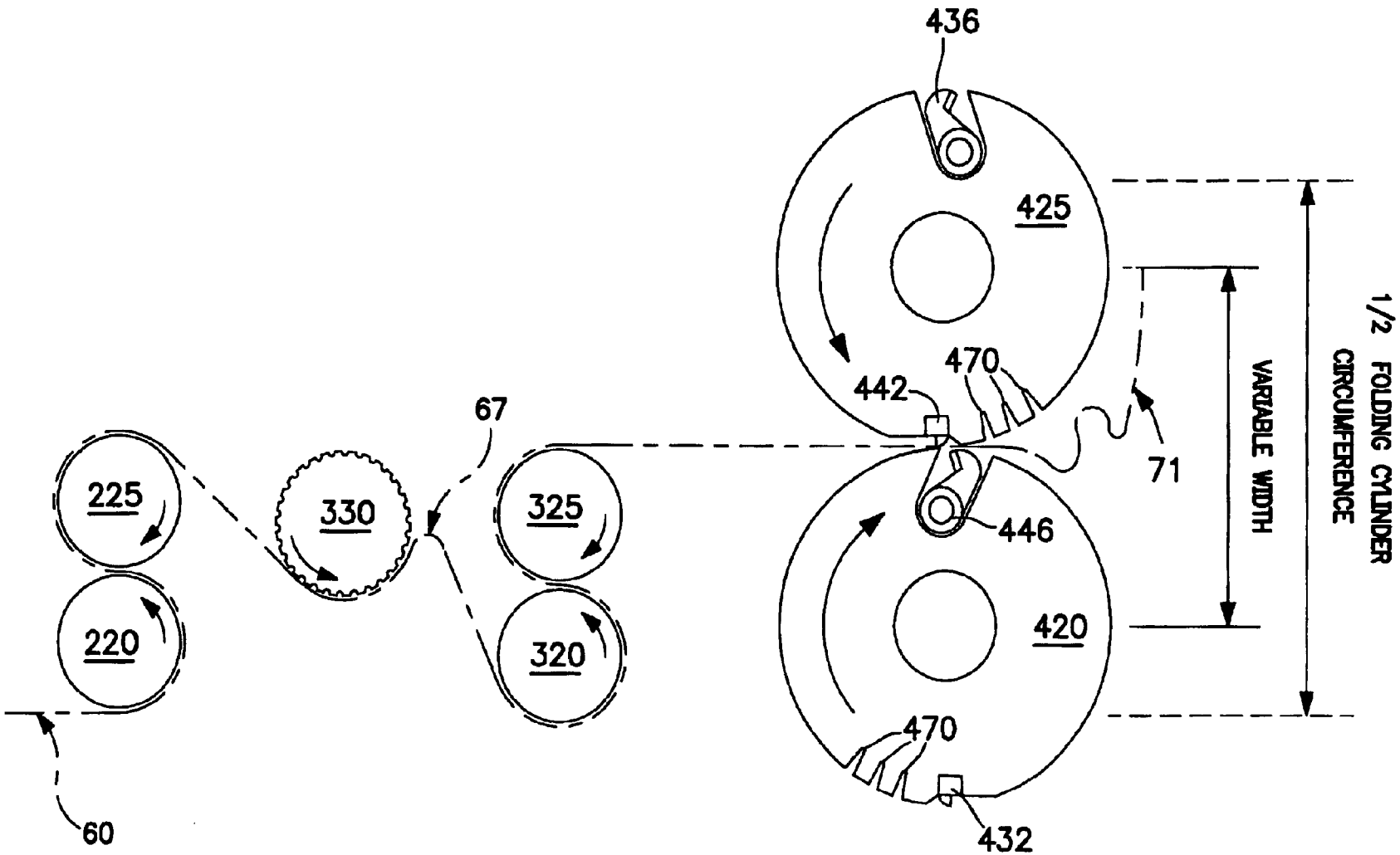
Figure 24:
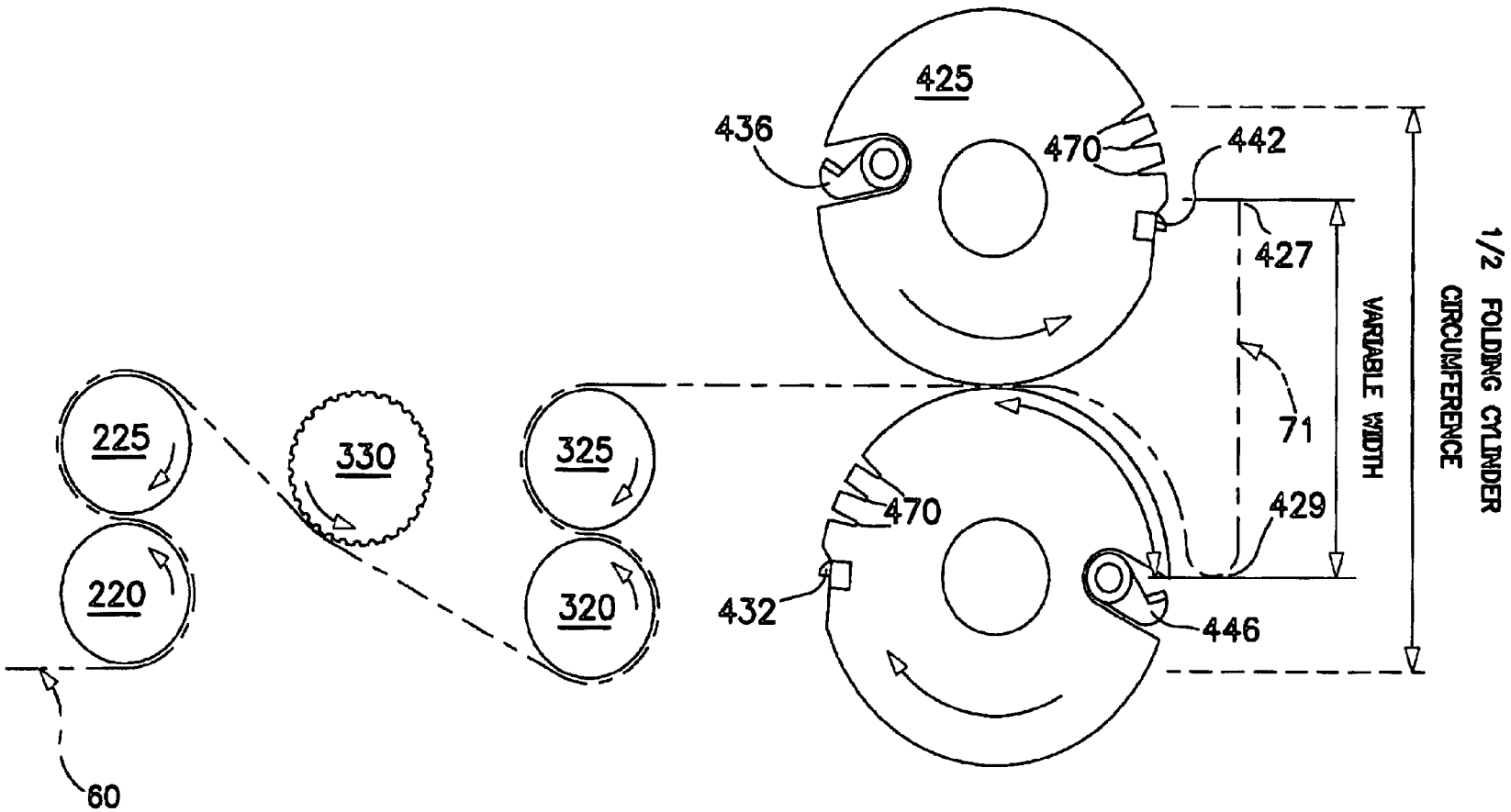

Just prior to the coaction of tucker 442 with gripper 446 to engage the web material therebetween the metering rolls 320, 325 accelerate to the surface speed of folding cylinders 420, 425 so that the gripped web material can be traveling at the surface speed of folding rolls 420, 425 (FIG. 23). The moving gripper jaw 446 on folding roll 420 then pulls the web material around to the predetermined drop-off point 429, amount if web material available being again equal to the amount supplied by the relatively slower, constant velocity pull rolls plus the amount of web material stored in the loop 67 (FIGS. 23 & 24).

The foregoing cycle is repeated for each tucker-gripper interaction, producing a zig-zag folded product of predetermined width that is less than the normal machine design width, i.e., less than one-half of the folding cylinder circumference. For each tucker-gripper interaction the metering rolls 320, 325 must have one deceleration phase and one acceleration phase.

The foregoing description and the accompanying drawings are illustrative of the present invention. Still other variations and arrangements of parts are possible without departing from the spirit and scope of this invention.

We claim:

1. A web folding machine suitable for processing at least one continuous feed of web comprises:

a frame;

at least one pull roll assembly rotatably mounted to the frame downstream from a web supply, the pull roll assembly driven to contact and pull the web from the web supply and to produce a feed of web at a substantially constant rate;

at least one driven metering roll assembly rotatably mounted to the frame downstream from the pull roll assembly for receiving the feed of web in contact therewith;

a driven take-up cylinder between the pull roll assembly and metering roll assembly and in contact with the feed of web for retaining any slack web portion between the pull roll assembly and metering roll assembly; and a pair of driven, co-acting folding cylinders rotatably mounted to the frame downstream from the metering roll assembly and in contact with the feed of web for folding the feed of web.

2. The web folding machine in accordance with claim 1 wherein at least one folding cylinder of the pair is contiguous with the metering roll assembly for accepting a direct transfer of the web therefrom, the folding cylinders being provided with at least one folding mechanism for creating a fold in the web.

3. The web folding machine in accordance with claim 1 wherein the co-acting folding cylinders are provided with vacuum ports for releasably holding a portion of the web on the folding cylinders.

4. The web folding machine in accordance with claim 1 further provided with a movable cutter device for severing a folded web portion into segments of predetermined width.

5. The web folding machine in accordance with claim 1 wherein the driven take-up cylinder is provided with a plurality of vacuum ports for releasably holding a portion of the web.

6. The web folding machine in accordance with claim 1 wherein a marker roll station is provided upstream from the pull roll assembly but downstream from a web supply, the marker roll station comprising at least one marker roll in contact with the feed of web.

7. The web folding machine in accordance with claim 1 wherein each pull roll assembly is independently driven.

8. An adjustable web folding machine suitable for processing at least one continuous feed of web comprising:

a frame;

at least one pull station located on the frame downstream from a web supply, the pull station comprising a pair of pull rolls rotatably mounted to the frame and driven to contact and pull web from the web supply and produce a feed of web at a substantially constant rate;

at least one metering station downstream from the pull station, the metering station comprising a pair of driven metering rolls rotatably mounted to the frame, the feed of web contacting and extending between the metering rolls, the metering station further comprising a rotatable take-up drum between the metering rolls and the pull rolls, driven in synchronism with the metering rolls for contacting and holding a slack portion of the web between the metering rolls and the pull rolls; and at least one folding station downstream from the metering station and comprising a pair of driven, co-acting folding cylinders rotatably mounted to the frame.

9. The adjustable web folding machine in accordance with claim 8 wherein the co-acting folding cylinders are provided with vacuum ports for releasably holding a portion of the web.

10. The adjustable web folding machine in accordance with claim 8 wherein each pair of pull rolls is independently driven.

11. The adjustable web folding machine in accordance with claim 8 wherein a marker station is provided upstream from the pull station and comprises a pair of rotatable marker rolls pivotably attached to the frame for guiding the web and displacing the web a predetermined distance at predetermined intervals.

12. The web folding machine in accordance with claim 8 wherein each of said folding cylinders is provided with a web-contacting knurled surface.

13. A method for folding at least one continuously feed web from a web supply and comprising the steps of:

drawing the web from the web supply with a pull roll assembly;

feeding the web from the pull roll assembly to a metering roll assembly at a predetermined web feed rate;

transferring the web from the metering roll assembly to a pair of folding cylinders;

taking up any slack portion of the web between the pull roll assembly and metering roll assembly with a slack take-up roll located there-between; and creating a fold in the web of material with a folding mechanism on the folding cylinders.

* * * * *